US011685474B2

(12) United States Patent
Howard-Willis et al.

(10) Patent No.: US 11,685,474 B2
(45) Date of Patent: Jun. 27, 2023

(54) HUMAN POWERED HYDROFOIL VEHICLE AND USE METHOD

(71) Applicant: Bright Spark Innovations GP Limited, Hamilton (NZ)

(72) Inventors: Guy Howard-Willis, Hamilton (NZ); Rolando Cruz Alonzo, Hamilton (NZ)

(73) Assignee: BRIGHT SPARK INNOVATIONS GP LIMITED, Hamilton (NZ)

( * ) Notice: Subject to any disclaimer, the term of this patent is extended or adjusted under 35 U.S.C. 154(b) by 0 days.

(21) Appl. No.: 17/845,335

(22) Filed: Jun. 21, 2022

(65) Prior Publication Data

US 2022/0324536 A1 Oct. 13, 2022

Related U.S. Application Data

(63) Continuation of application No. 16/490,849, filed as application No. PCT/IB2017/055917 on Sep. 27, 2017, now Pat. No. 11,396,349.

(Continued)

(51) Int. Cl.
*B63B 1/24* (2020.01)
*B63B 34/40* (2020.01)

(Continued)

(52) U.S. Cl.
CPC ..... *B63B 1/246* (2013.01); *B63B 1/248* (2013.01); *B63B 1/26* (2013.01); *B63B 34/40* (2020.02);

(Continued)

(58) Field of Classification Search
CPC ..... B63B 1/24; B63B 1/246; B63B 1/248; B63B 1/26; B63B 34/40; B63B 34/50;

(Continued)

(56) References Cited

U.S. PATENT DOCUMENTS 4,014,283 A 3/1977 Crnogorac
5,316,508 A 5/1994 Landucci (Continued)

FOREIGN PATENT DOCUMENTS

CN 202152087 U 2/2012
CN 202923810 U 5/2013

(Continued)

OTHER PUBLICATIONS

International Search Report dated Apr. 30, 2015, for related Application No. PCT/NZ2014/000247 (6 pages).

*Primary Examiner* — Daniel V Venne
(74) *Attorney, Agent, or Firm* — Burns & Levinson, LLP; Joseph M. Maraia

(57) ABSTRACT

The human powered hydrofoil bicycle includes multiple subsystems integrated together including a structural frame subsystem with associated steering and tiller module, a hydrofoil subsystem to provide vehicle lift, and a powertrain subsystem. The structural frame subsystem may be fitted with buoyancy modules to provide the overall vehicle with a near neutrally buoyant character. The structural frame subsystem also supports a seat for an operator and provides structural support for the steering and tiller module for the hydrofoil subsystem and the drivetrain subsystem. The hydrofoil subsystem includes multiple hydrofoil elements at lowermost portions of the vehicle. These hydrofoil elements generally include in a preferred embodiment a larger rear foil and a smaller front foil. The powertrain subsystem generally includes pedals rotatably supported on the vehicle at a convenient location for engagement and driving by feet of an operator. Power transmission elements extend from the pedals down to a prime mover such as a propeller.

20 Claims, 21 Drawing Sheets

Related U.S. Application Data

(60) Provisional application No. 62/467,668, filed on Mar. 6, 2017.

(51) Int. Cl.

| | |
|---|---|
| ***B63B 34/50*** | (2020.01) |
| ***B63B 1/26*** | (2006.01) |
| ***B63H 1/14*** | (2006.01) |
| ***B63H 16/20*** | (2006.01) |
| ***B63H 23/34*** | (2006.01) |
| ***B63H 16/00*** | (2006.01) |

(52) U.S. Cl.
CPC ..... *B63B 34/50* (2020.02); *B63H 1/14* (2013.01); *B63H 16/20* (2013.01); *B63H 23/34* (2013.01); *B63H 2016/005* (2013.01); *B63H 2016/202* (2013.01)

(58) Field of Classification Search
CPC ..... B63H 16/20; B63H 2016/005; B63H 2016/202; B63H 23/34; B63H 1/14; B63H 16/14
USPC ..... 440/21, 26, 27, 29, 30; 114/271, 274, 114/278
See application file for complete search history.

(56) References Cited

U.S. PATENT DOCUMENTS

| | | | | |
|---|---|---|---|---|
| 5,374,206 | A | 12/1994 | Gregory | |
| 5,807,148 | A | 9/1998 | Siviero | |
| 6,099,369 | A | 8/2000 | Puzey | |
| 7,021,232 | B2 | 4/2006 | Chen | |
| 7,662,004 | B1 | 2/2010 | March et al. | |
| 9,180,949 | B2 | 11/2015 | Hansen | |
| 10,272,981 | B2 * | 4/2019 | Caccia | B63H 16/12 |
| 2009/0120346 | A1 | 5/2009 | Chen | |

FOREIGN PATENT DOCUMENTS

| | | | |
|---|---|---|---|
| WO | 2008039103 | A1 | 4/2008 |
| WO | 2009035252 | A2 | 3/2009 |
| WO | 2015093984 | A1 | 6/2015 |

* cited by examiner

FIGURE - 2C (ii)

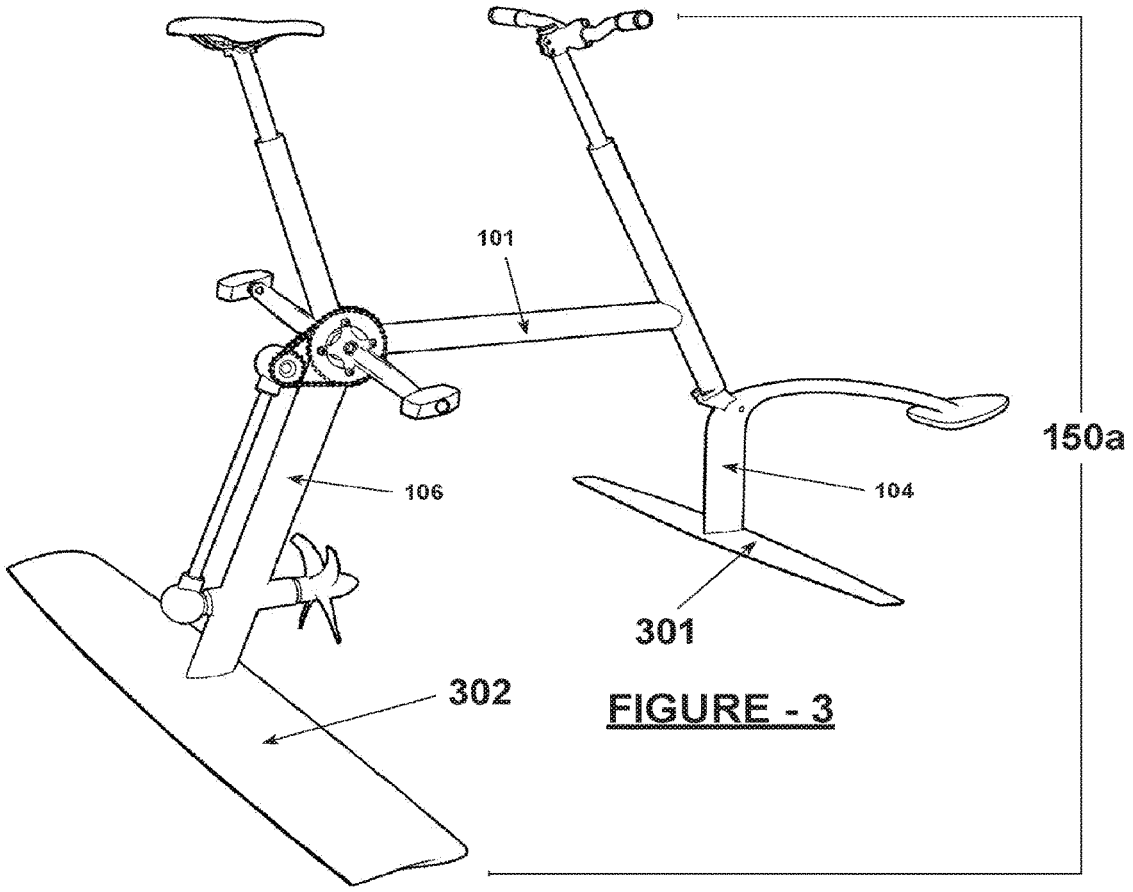
FIGURE - 3
FIGURE - 3A
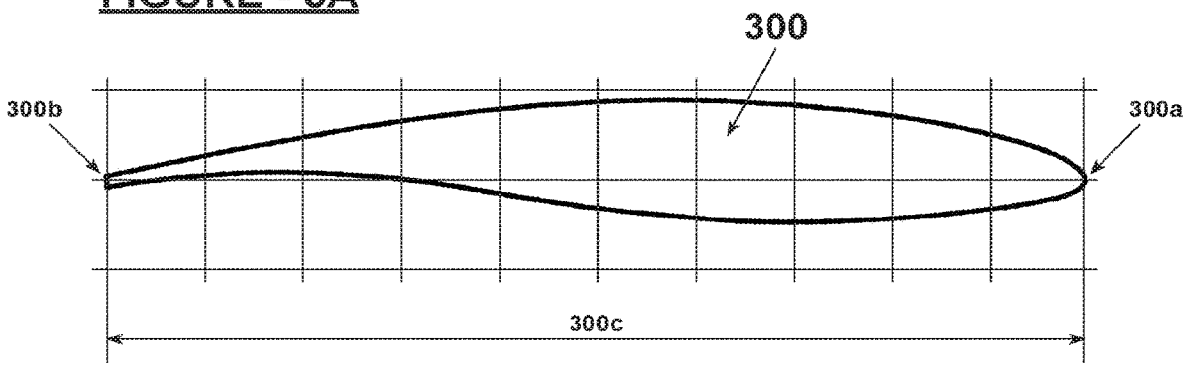

FIGURE - 5B (ii)

FIGURE - 5B (iii)

HUMAN POWERED HYDROFOIL VEHICLE AND USE METHOD

CROSS REFERENCE TO RELATED APPLICATIONS

This application is a continuation of co-pending U.S. application Ser. No. 16/490,849, which is a U.S. national phase entry under 35 U.S.C. § 371 of International Application No. PCT/IB2017/055917, filed Sep. 27, 2017, entitled HUMAN POWERED HYDROFOIL VEHICLE AND USE METHOD, which in turn claims priority to and benefit of U.S. Provisional Application No. 62/467,668, filed Mar. 6, 2017, the contents of which are incorporated herein by reference in their entirety for all purposes.

TECHNICAL FIELD

The present invention relates to a device for use for transport over water and a method for using same. The invention has particular application to hydrofoil bikes, although it could be applied to other vehicles as appropriate.

BACKGROUND ART

Hydrofoil vehicles are those which are provided with hydrodynamic foils (which, for ease of reference, will now be referred to as foils) in a manner similar to aerofoils, such as those found on fixed-wing aircraft.

A foil is a wing-like structure which is suspended transversely and horizontal under the hull of the vehicle (usually a boat such as a racing yacht or speedboat) and beneath the water surface. Typically, a hydrofoil vehicle will have at least two foils.

When stationary, the hull of the hydrofoil vehicle rests on the water. However, when the vehicle is in motion at a sufficient speed, the foils generate lift—and the bulk, if not all of the hull of the vehicle, will rise out of the water as it moves. The foils may remain fully submerged or partially pierce the water surface (the latter is more common for larger vehicles such as passenger ferries).

Being lifted largely out of the water, water resistance and drag along the hull is reduced and thus greater traveling speeds can be achieved with a reduced thrust or power output. Furthermore, because the foils move beneath the surface of the water, the vehicle is less susceptible to waves and thus can achieve a smoother ride.

Foils have been used on boats such as ferries for many decades as a means for efficient and timely transportation of people and cargo. Publicity generated by the foil-equipped yachts used in the 2013 America's Cup has also increased awareness of foils.

However, the use of human powered hydrofoil vehicles in water sport activities is becoming increasingly common. Many of these types of hydrofoil vehicles are custom-built by enthusiasts, but there is increasing commercial activity in the industry.

Human powered hydrofoil vehicles can be classified into two main groups. The first group are those which are buoyant. This type of vehicle has foils which are attached to the hull of a conventional water craft such as a kayak or canoe. When not being powered by the person using the device, the water craft will remain buoyant. However, human powered hydrofoil vehicles that have hulls can require considerable effort to drive the vehicle at a speed sufficient to generate enough lift for it to be raised at least partially out of the water. Furthermore, because a hull needs to be large enough to keep the combined static weight of the vessel and rider afloat, the consequential bulk brings along with it performance penalties when in motion. Larger hulls introduce heavier payloads, transport/storage constraints, and higher production costs. Therefore hydrofoil bikes with hulls have a number of design issues which limit their appeal.

The second group of human powered hydrofoil vehicles are those that lack buoyancy, and which will sink if insufficient lift is generated by its foils. Essentially, this latter type of hydrofoil vehicle needs to be in continual motion in order to remain substantially out of the water.

This operational transformation from 'boat to plane' poses certain disadvantages especially for pedal-powered hydrofoil craft, due to the limitations of human energy. Thus users need to be relatively fit individuals and this can limit the popular appeal of these types of vehicles.

Human powered hydrofoil vehicles require propulsion to be generated through the use of an input device operated by the user. The input device can be configured to be operable by physical movement such as a rowing, pumping or pedaling action.

Hydrofoil vehicles with pedal-driven propellers tend to be less strenuous to operate than those requiring a pumping or rowing action. Such vehicles often resemble bicycles with foils in place of the front and rear wheels. The user will operate the pedals to drive a propeller proximate the foils, thus moving the machine forward in the water. If sufficient forward momentum can be sustained, the foils generate lift to raise the vehicle substantially out of the water. These types of vehicles shall now be referred to as hydrofoil bikes.

Existing hydrofoil bikes tend to be relatively complicated assemblies. Typically, a key design focus is to keep the hydrofoil bike as light as possible. However, this can compromise the structural integrity of the bike.

Thus, hydrofoil bikes may be prone to breakage when the foils or propeller blades strike the ground, both in and out of water. They also tend to be relatively difficult to assemble and disassemble for transportation or storage purposes. Some hydrofoil bikes come in a multitude of parts, which require extensive and time consuming assembly with specialist tools. Others come in relatively few but large components, but these can be too difficult or impractical to transport in a passenger car.

Hydrofoil bikes that lack hulls, in addition to requiring a high strength individual, also require good timing and coordination when launching as the user has to be able to generate sufficient and immediate forward momentum for the foils to generate lift. Above-water launching usually requires the person using the bike to start from a jetty, dock or the like, with the vehicle momentarily suspended above the water, and is lowered simultaneously with a forward lunge or push-off motion followed by prompt pedal strokes.

Without a hull, a stationary bike and its user are immersed in the water, and launching from this starting position is difficult to achieve. Consequently, if the user loses balance or is otherwise forced to dismount the hydrofoil bike, the user runs the risk of getting stranded far from shore. The user may be forced to abandon the bike and swim back to shore. If not retrievable because of water depth or other factors, this may mean the loss of the bike.

It is an object of the present invention to address the foregoing problems and provide the public with a useful choice other than hulled hydrofoil bikes or hull-less hydrofoil bikes.

All references, including any patents or patent applications cited or described in this specification are hereby incorporated by reference. No admission is made that any reference constitutes prior art. The discussion of the references states what their authors assert, and the applicants reserve the right to challenge the accuracy and pertinence of the cited documents.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps. Further aspects and advantages of the present invention will become apparent from the ensuing description which is given by way of example only.

DISCLOSURE OF THE INVENTION

According to one aspect of the present invention, there is provided a hydrofoil vehicle, comprising in combination:

- a substantially rigid frame having a front section and a rear section;
- a front foil connected beneath said front section of said frame;
- a rear foil connected beneath said rear section of said frame;
- said front foil and said rear foil each having an elongate form extending primarily laterally to vehicle motion and primarily horizontally, and with a foil shape and orientation which causes lift when moving forward through water;
- a prime mover located beneath and supported by said frame, said prime mover powered by a power source carried by said frame;
- said prime mover coupled to said power source through a drive train therebetween, said prime mover extending forward from portions of said drive train adjacent to said prime mover; and
- said prime mover located at least partially above a lowermost one of said front foil and said rear foil.

In some forms of the hydrofoil vehicle the prime mover may be located entirely above said lowermost one of said front foil and said rear foil. The prime mover may be located forward of said rear foil and rearward of said front foil.

In some forms of the hydrofoil vehicle the rear foil is lower than said front foil, and the prime mover is located above said rear foil and supported by a rear section of said frame. The prime mover is preferably located above a line extending between said rear foil and said front foil. Preferably the prime mover includes at least one propeller.

In some forms of the hydrofoil vehicle the power source includes pedal cranks rotatably mounted to a frame and with said pedal cranks coupled to said prime mover to power said prime mover as said pedal cranks rotate, said pedal cranks adapted to be rotated by a human rider carried upon said frame.

In some forms of the hydrofoil vehicle at least one of said front foil or said rear foil includes a cross-sectional form with a convex upper surface and a recurve lower surface, including a convex forward portion and a concave rearward portion.

In some forms of the hydrofoil vehicle the prime mover is coupled to a drive shaft which causes said prime mover to rotate, said driveshaft coupled to said prime mover through a free wheel linkage which causes said prime mover to rotate when said driveshaft rotates in a first direction, and which does not cause said prime mover to rotate when said driveshaft rotates in a second direction opposite side first direction.

The hydrofoil vehicle may include at least one buoyancy module removably attachable to said frame, said at least one buoyancy module adding sufficient buoyancy to the hydrofoil vehicle to cause it to have positive buoyancy.

In some forms of the hydrofoil vehicle the at least one of said front foil or said real foil has an elongate form with a lower central portion coupled to said frame and with elevated left and right extremities, and with said left and right extremities coupled to said lower central portion through diagonal intermediate portions. In other forms of the hydrofoil vehicle the at least one of said front foil or said rear foil has an elongate form with an oval contour when viewed from above, with a longest chord length at a central portion thereof and with rounded left and right extremities.

In some forms of the hydrofoil vehicle the cross-section of at least one of said foils has a square trailing edge where said upper surface of said foil and said lower surface of said foil come together.

In another aspect of the present invention, there is provided a hydrofoil vehicle with advanced hydrofoil contours, comprising in combination:

- a frame having a front section and a rear section;
- a front foil connected beneath said front section of said frame;
- a rear foil connected beneath said rear section of said frame;
- said front foil and said rear foil each having an elongate form extending primarily laterally and with a shape and orientation which causes lift when moving forward through water;
- a prime mover located beneath and coupled at least indirectly to said frame, said prime mover powered by a power source carried by said frame;
- said prime mover coupled to said power source through a drive train therebetween, said prime mover extending forward from portions of said drive train adjacent to said prime mover; and
- wherein at least one of said front foil or said rear foil includes a cross-sectional form with a convex upper surface and a recurve lower surface including a convex forward portion and a concave rearward portion.

In some forms, the cross-section of at least one of said foils has a highest portion of said upper surface between 30% and 50% of the way from a leading edge to said trailing edge, and wherein said lower surface has a lowest portion between 20% and 40% of the way from said leading edge to said trailing edge, and wherein said lower surface has an inflection point between 40% and 70% of the way from said leading edge to said trailing edge, and wherein said lower surface has a concave portion with a highest portion thereof between 70% and 90% of the way from said leading edge to said trailing edge, and wherein a vertical thickness of said cross-section of said at least one foil has a maximum thickness at a location between 20% and 50% of the way from said leading edge to said trailing edge, which maximum thickness portion is between 10% and 20% of said chord length of said cross-section.

In some forms the prime mover may be located at least partially above a lowermost one of said front foil and said rear foil.

In some forms at least one buoyancy module may be removably attachable to said frame, said at least one buoyancy module adding sufficient buoyancy to the hydrofoil vehicle to cause it to have positive buoyancy.

In some forms at least one of said front foil and said rear foil may be removably connected beneath said frame, through a joint which facilitates rapid removal and secure re-attachment to said frame. Preferably the rear foil is removably connected beneath said frame through a wedge-type bayonet Interface joint with male and female counterparts and with one of said counterparts affixed to a central portion of said rear foil and with another of said counterparts affixed to a lower portion of said rear section of said frame, said counterparts arranged so that said wedge-type bayonet interface is caused to be tightened by force of water acting on said rear foil as the vehicle moves relative to water in a forward direction.

In some forms a plurality of separate foils are provided, and the joint through which said foils are connected to said frame allows said plurality of separate foils to be swapped with each other, with one of said plurality of separate foils connected to said frame through said joint.

In another aspect of the present invention, there is provided a hydrofoil bike, comprising in combination:

a frame having a front section and a rear section;

a front foil connected beneath said front section of said frame;

a rear foil connected beneath said rear section of said frame;

said front foil and said rear foil each having an elongate form extending primarily laterally and with a shape and orientation which causes lift when moving forward through water;

a prime mover located beneath and coupled at least indirectly to said frame, said prime mover powered by a power source carried by said frame;

said prime mover coupled to said power source through a drive train therebetween, said prime mover extending forward from portions of said drive train adjacent to said prime mover; and wherein said prime mover is coupled to a drive shaft which causes said prime mover to rotate, said driveshaft coupled to said prime mover through a free wheel linkage which causes said prime mover to rotate when said driveshaft rotates in a first direction, and which does not cause said prime mover to rotate when said driveshaft rotates in a second direction opposite side first direction.

The driveshaft may include a ratchet with a series of ratchet teeth extending radially therefrom and which are slanted in one rotational direction, said prime mover having at least one pawl with teeth associated therewith which engage said ratchet teeth of said ratchet when the driveshaft rotates in said first direction, but which allows the prime mover to freewheel and not rotate when said driveshaft rotates in a second direction opposite side first direction.

In some forms the prime mover may be located at least partially above a lowermost one of said front foil and said rear foil.

In some foams the at least one of said front foil or said rear foil may include a cross-sectional form with a convex upper surface and a recurve lower surface including a convex forward portion and a concave rearward portion.

In another aspect of the present invention, there is provided a hydrofoil vehicle, comprising in combination:

a substantially rigid frame having a front section and a rear section;

a front foil connected beneath said front section of said frame;

a rear foil connected beneath said rear section of said frame;

said front foil and said rear foil each having an elongate form extending primarily laterally to vehicle motion and primarily horizontally, and with a foil shape and orientation which causes lift when moving forward through water;

a prime mover located beneath and supported by said frame, said prime mover powered by a power source carried by said frame;

said prime mover coupled to said power source through a drive train therebetween, said prime mover extending forward from portions of said drive train adjacent to said prime mover; and wherein at least one buoyancy module is removably attachable to said frame, said at least one buoyancy module adding sufficient buoyancy to the hydrofoil vehicle to cause it to have positive buoyancy.

The at least one buoyancy module may include a frame front section buoyancy module and a frame rear section buoyancy module, said frame front section buoyancy module having a lower density than water and configured to be attached to said front section of said frame, said frame rear section buoyancy module having a lower density than water and configured to be attached to said rear section of said frame. In some forms the front section buoyancy module and said rear section buoyancy module include two halves which are removably attachable together and with a contour on portions thereof facing each other which correspond with a contour of frame sections to which they attach. The rear section buoyancy module may be sufficiently narrow to avoid interfering with legs of a user when said power source includes pedal cranks rotatably mounted to said frame and with said pedal cranks coupled to said prime mover to power said prime mover as said pedal cranks rotate, said pedal cranks adapted to be rotated by a human rider carried upon said frame.

According to another aspect of the present invention, there is provided a hydrofoil bike, wherein the bike includes:

a frame with a front hydrofoil and a rear hydrofoil, a propeller assembly, and a drivetrain assembly linked to the propeller assembly, characterized in that the bike includes at least one buoyancy module configured to be mounted to at least a portion of the frame.

The bike includes a means of providing buoyancy to assist the user in starting from a submerged condition. The buoyancy module also helps to minimize the risk that the bike would sink should the user be separated from it.

The major components of the preferred embodiment of the hydrofoil bike are:

a frame with front and rear struts;

one or more buoyancy modules;

at least two hydrofoils, with at least one hydrofoil associated with each of the front and rear struts;

a steering assembly;

a tiller module (which may be considered to be part of the steering assembly);

a drivetrain assembly; and a propeller assembly.

Frame

The bike can be understood in an exemplary embodiment to have a frame, which in some forms is a one-piece structure akin to a conventional bike frame, essentially having a head tube, a seat tube, and a bottom bracket (where typically the main components of the drivetrain assembly are mounted).

This frame essentially consists of a substantially horizontal member (the main body) connecting front and rear sections arranged substantially vertically at either end. The lower ends of these front and rear sections can be understood to be the struts which are associated with the front and rear foils respectively.

The pedals associated with the drivetrain assembly should have ample clearance so as not to strike the frame or the water surface during cruising operation.

The struts may be integral with the front and rear sections of the frame, but in some embodiments are separate components. In particular, the strut associated with the front section is a separate component in this exemplary embodiment, as will be discussed later in this specification.

As noted above, preferably the front and rear sections of the frame are formed as a unitary structure, but it is possible that one or both of the front and rear members may be formed separately from the main frame and connected using conventional joint techniques or the like.

The front section can be understood to be a head tube with a channel passing through from its upper end to its lower end (to which the front strut is located). It will be understood that in use, the front section is associated with the steering assembly as well as the front foil.

The rear section of the frame should be understood to have upper and lower ends. The upper end of the rear section of the frame can either include a seating area for the user or at least a means to attach a seat to provide a seating area, such as a conventional bicycle saddle. It will be understood that the upper end of the rear section effectively functions as a scat tube into which a saddle, mounted to a post, can be inserted. A clamp may be used about the seat tube to lock the seat post in place. This form of seat attachment method is similar or identical to that used to attach a saddle to a conventional bicycle. Thus, off-the-shelf saddles and clamps may be readily used with the invention. However, this is not meant to be limiting and alternative ways of attaching a seating area to the frame will be readily envisaged. For example, this may include a seat integrally formed with the frame.

The lower end of the rear section of the frame includes equipment to provide attachment of the drivetrain assembly. This may be achieved in a number of ways.

For example, when the drivetrain assembly includes a crank and pedal assembly, a transverse aperture may be provided in the lower end of the rear section for the axle of the crank. This will be understood to be the bottom bracket.

The material selected for constructing the frame should ensure that it is structurally sound. In preferred embodiments, the frame is formed from a relatively light metal alloy such as aluminium. However, this is not meant to be limiting and the frame may alternatively be formed from plastic materials such as high density polyethylene (HDPE), acrylonitrile butadiene styrene (ABS), polycarbonate (PC), fiber-reinforced plastics (FRP), or any other materials readily identified by a person skilled in the art as being suitable for the purpose. It will be appreciated that the recited materials for the frame are just examples, and are not meant to be limiting.

It can be advantageous to provide the frame with some buoyancy as it means that the bike does not necessarily sink should the user be separated from it when in relatively deep water. The buoyancy distribution will allow the bike to float on its side. Its static float orientation will remain that way until deliberately manipulated. It is not difficult for a swimmer to change the orientation of the bike into a practical upright position for remounting. It is advantageous that the vehicle rests on its side when separated from the user. In this manner, half of the wingspan of the hydrofoils will be upright and above the water surface making the bike more visible for retrieval, and will also function as a safety marker for other water users nearby. A skilled individual will understand that the buoyancy distribution may be arranged to allow the bike to float in other orientations, such as upside down or in an upright position.

Preferably, the buoyancy has a magnitude of buoyant force sufficient that the user's head and shoulders remain above the water surface once the user has mounted the bike in a submerged condition. Persons skilled in the art will appreciate that because of the weight of the user, it is preferable to have the buoyancy appropriately distributed in order to compliment the centre of gravity of the vehicle. In use, this may mean that when the user has mounted the bike and it is in a submerged condition, the bike is oriented such that it is substantially near horizontal, and the user sits substantially upright.

The frame may be made buoyant in a number of ways. For example, some portions of the frame may be formed in such a way that a select number of sealed air compartments may be created in its interior.

Alternatively, the internal compartments of the frame, if not sealed, may be occupied by a bladder inflated with air or inert gas. Alternatively, buoyant material may be injected directly into the internal compartments of the frame. This buoyant material may vary depending on the manner of manufacture, and can be but is not limited to, expanding closed-cell foams or the like.

Buoyancy Modules

One preferred embodiment of the invention has a full load-bearing skeletal frame, and separate buoyancy modules that are non-load bearing structures. However, this is not meant to be limiting as the frame may be incorporated with the modules to produce one unified load-bearing yet buoyant monocoque shell structure.

The bike can be understood to include buoyancy modules that are configured to attach or couple with portions of the frame. These buoyancy modules may be used to supplement a partially buoyant frame. Alternatively, these modules may be used to provide all the necessary buoyancy requirements and features to a non-buoyant frame.

Auxiliary buoyancy modules or pods may be configured to attach or couple with strut extensions originating from the main foils themselves.

It is desirable that the resultant buoyancy effects are complimentary to the lift that is progressively generated by the hydrofoils; as these buoyant modules move forward underwater; and as they break onto or above the water surface.

A minimal buoyancy amount may be optimized and distributed to interact condusively with the combined static weight of the bike and user; so as to keep the bike as stable as possible during re-mounting and re-launching from a submerged but stationary condition; and to assist in lifting the bike and user out of the water from very slow speeds initially. It is not beyond the scope of the invention that a maximum amount of buoyancy may be employed to keep the bike and user substantially above the water surface, during re-mounting and re-launching in open water.

The buoyancy modules may be configured in a number of ways but are preferably made from light-weight closed-cell foam materials which is formed by using conventional injection molding techniques. In some forms, the outer surfaces of the buoyancy modules may be reinforced with a thin plastic skin or covering. In other forms, the buoyancy modules may be sealed hollow shells that are substantially rigid, or flexible inflatable membranes.

The bike may be fitted with one or several segmented buoyancy modules. For example, one module may be fitted to the main upper frame while others may be fitted to the lower portions of the front and rear sections. This allows the buoyancy of the bike to be distributed to favour either its front of rear.

Multiple buoyancy modules can help simplify and reduce manufacturing costs as the molds to form the modules need not be as large.

The number of modules fitted to the bike may vary. For example, the bike may be fitted with several smaller buoyancy modules instead of one large one. This can help with the overall assembly and partial disassembly (for repairs and maintenance) of the bike, while at the same time allowing a smaller packaging and storage footprint. However, regardless of their placement on the frame of the bike, the buoyancy modules needs to be positioned correctly in such a way that they are predominantly raised out of the water once the bike is in its cruising orientation. This is so as not to incur a drag penalty at higher cruising speeds.

In some embodiments, the buoyancy modules are complementary when they are used in pairs, one for either side of the bike. However, this is not essential. In some forms of the invention, the buoyancy modules are comprised of split sections in such a way that these sections when attached to the bike, encapsulate its load-bearing frame.

A number of different methods may be employed to secure the buoyancy modules to the bike, preferably one which allows them to be quickly attached and removed on a regular basis. For example, the buoyancy modules may include flanges or embedded appendages or the like through which fasteners such as tics, clips, screws, straps or the like may pass into the appropriate recesses or apertures in the frame. When used in pairs, the flanges or embedded appendages of the respective modules may be configured to interlock with each other. Smaller segmented modules may also be unified permanently or semi-permanently by utilizing contact adhesives, or self-adhesive tapes.

It should be understood that the buoyancy modules will create a larger overall surface area compared to that of a bare frame with all its operational assemblies exposed. However, flow turbulence is minimized because these modules introduce effective hydrodynamic streamlines. Therefore, overall drag is decreased and performance is improved both underwater and above the water surface.

This is preferred not only for improving water or airflow around the bike, but they also improve the aesthetic appearance of the bike without compromising frame strength. A more professional looking hydrofoil bike, with purposeful similarities to shapes and forms found in various other high performance vehicles, may foster market acceptability.

In some embodiments, the buoyancy modules may be configured with a port to allow entry of water into one or more hollow interior compartments. For example, a buoyancy module may be molded with strategically located internal cavities, whereby matching buoyant counterparts (or plugs) can be inserted back in, to achieve maximum buoyancy. However, when certain plugs are removed, water will be allowed to enter these cavities, which can subsequently act as ballast. This allows some degree of latitude for the user to fine-tune the amount or position of buoyancy in the bike according to preference.

Furthermore, for modules that feature ballast compartments, entry and exit vents are incorporated so that water can both enter and drain away quickly. Thus, the added weight of the ballast is eliminated once the modules are raised above the surface of the water.

Hydrofoils

The bike can be understood to have at least one front hydrofoil and at least one rear hydrofoil (referred to throughout the remainder of this specification as foils). A foil should be understood to have a leading edge and a trailing edge, which correspond to the front and rear edges of the foil in use.

Main foils and/or auxiliary foils are connected to the frame by way of struts. The struts may be intermediary members, fitted to the lower ends of the front and rear sections of the bike frame, or may be fitted to the lower ends of the front and rear sections themselves. Large auxiliary foils (or smaller winglets) may be connected directly to, or by way of secondary strut extensions originating from; above, below, or at the ends of the main foils themselves.

In preferred embodiments of the invention, the front strut is an intermediary member, discussed in more detail below, while the rear strut is the lower end of the rear section. The front foil is associated with the front strut and the rear foil is associated with the rear strut.

Each foil should be understood to be a substantially transverse horizontal wing-like structure suitably configured to generate lift and has an upper surface and a lower surface.

The foil is contoured to create a pressure differential from the laminar flow of the fluid passing above and below the foil surfaces. Depending on the contour of the foils, a desired lift characteristic can be achieved. Many foils are known in the prior art with a profile suitable for generating lift. For example, the foil profile may be based on one of the National Advisory Committee for Aeronautics (NACA) designs. Most preferably a unique and optimized supercritical airfoil profile is provided, at least for the main foil, for beneficial lift and drag characteristics when passing through water at speeds of generally about 5 to 40 kilometers per hour (3 to 25 miles per hour, 2.7 knots to 21 knots).

Reference will be made in some sections of this specification to the foils having an angle of attack. This should be understood to mean the angle of the foil relative to the flow of fluid around it, wherein the angle is determined by the chord of the foil.

The chord is the straight line running between the leading edge of the foil and the trailing edge of the foil. If the chord is such that the leading edge is higher than the trailing edge, the foil is raised (inclined) or has a positive angle of attack. If the trailing edge is higher than the leading edge, the foil is lowered (declined) and has a negative angle of attack.

It will be appreciated that an upright but seated operator in a conventional pedaling position places most of the user's weight near the rear of a bicycle. In preferred embodiments of the invention, the rear foil is larger than the front foil. The correlation of foil size is to compensate for the fact that in use, the rear foil is substantially closest to the centre of gravity of the bike. Therefore, the rear foil needs to generate most of the lift required to support the combined weight of the bike and its payload (the user at a minimum).

In some embodiments of the invention, the smaller front foil is attached to the lower end of the front strut. In turn, the upper end of the front strut is pivotally attached to the front section of the frame whereby it can pivot along a transverse axis. Therefore the bottom of the front strut is able to swing from its upper pivotal attachment along a predetermined arc. The resulting movement of the lower end of the front strut is utilised to determine the effective operational angle of attack of the front foil. The front strut is also concurrently actuated by a tiller mechanism (discussed later in this specification). This provides self-correcting pitch and elevation control for the front foil.

Furthermore, the upper pivotal attachment of the front strut can be integrated as part of a steering fork mechanism installed at the front section of the frame, but this is not meant to be limiting. This arrangement will enable the front strut to function as a rudder. To facilitate this, the front strut may be configured accordingly, with sufficient side area that can produce effective rudder control.

The span of the foils extend well to the sides of the bike in use. Thus, they are relatively exposed and vulnerable to impacts from both floating and submerged objects, which may not always be visible to the person riding the bike. Therefore, the foils need to be appropriately engineered and formed from robust materials that provide an acceptable degree of resilience against bending, impacts and abrasions.

In preferred embodiments of the invention, the front and rear foils are mounted to their respective struts such that in use, the rear foil is positioned lower than the front foil. At cruising speeds, the front foil will plane at an appropriate distance beneath the water surface, while the rear foil planes behind at a further distance beneath the water surface. This is to avoid, as much as possible, any turbulence streaming behind the front foil.

In some embodiments of the invention, the bike may be provided with one or more auxiliary foils in addition to the front and rear foil, which in these embodiments will be understood to be primary foils. Preferably, any auxiliary foils are mounted to the rear strut. It will be appreciated that the rear strut and/or rear section of the frame may need to be configured with a suitable mounting structure to achieve this.

For example, the rear strut may be configured with recesses or sockets, into which a two-part auxiliary foil, can be inserted on either side of the bike. In another example, the auxiliary foil, either complete or in partial sections, can be incorporated into a compounded main foil design. These examples demonstrate how an auxiliary foil may be added to the hydrofoil bike, and other ways of achieving this will be readily envisaged by a person skilled in the art.

In these embodiments of the invention, auxiliary foil (or foils as the case may be) is positioned above the primary foils.

Preferably, the height of auxiliary foils relative to the frame of the hydrofoil bike is such that it is raised above the surface of the water when cruising speeds are attained. The auxiliary foils are useful in that they can provide supplementary lift when launching at low speeds from a submerged condition, but will not create a drag penalty at higher cruising speeds by virtue of them being out of the water.

In some embodiments of the invention, the main foils may be equipped with telescopic or swing-back mechanisms. The purpose of these mechanisms is to allow enlarged foil areas to create higher amounts of lift for submerged launching, which can be retracted or swung-back to discard surplus lift and excessive drag during higher cruising speeds. It will be appreciated that this is likely to require user-operated flexible cable mechanisms, or hydraulic circuit mechanisms, and the like.

In preferred embodiments of the invention, the foils are formed with an outer shell of carbon-fiber reinforced composite material, although it will be appreciated that other materials including fiber reinforced plastics (FRP) may readily be used. Furthermore, other types of material could be used as the basis for foil construction, an example being sheet or extruded lightweight metals such as aluminium.

Preferably, and regardless of the material from which the foils are formed, the interior of the foils are filled with light-weight high-density closed-cell foam. Besides adding structural strength to the foil itself, the foam also acts as a permanent barrier to stop the entry of water should a small crack or leak develop along the outer shell of the foil.

In preferred embodiments of the invention, detachable tips may be provided for the outer ends of the foils as foil-end plugs or extensions. These foil-ends can simply be replaced if damaged rather than replacing the entire foil. There are also advantages for storage and transport as the size of the foils can be reduced when the foil-ends are dismantled. The foil-ends may be fabricated from rigid or flexible materials such as plastic or rubber, whereby an elastomeric foil-end would provide a higher degree of resilience.

The use of foil-end extensions may also allow the user to alter or otherwise customize the hydrodynamic performance of the bike. For example, up-turned foil-ends may be added to alter the characteristic of the foils to improve high-speed straight line or cornering stability. They may also be shaped or otherwise profiled to further increase lift and so therefore increase load carrying capacity. Specialized foil-ends however, may incur a drag penalty as a trade-off. It will be appreciated that more power may be expended in order to gain specialised effects from foil-end variations.

The hydrodynamic performance of the bike may be adjusted through replacement of the foils themselves. Specialized foils and propellers can be installed for specific applications such as high speed sprinting, but low speed functionality has to be sacrificed in favor of high speed optimization. The invention can accept a variety of specialised foils/propeller pairings to replace the standard set-up without any change required to the bike frame or drivetrain.

As will be appreciated, the foils need to be suitably configured to attach or engage securely with the struts of the bike. In some embodiments, a quick-release interface may provide quick and easy installation/removal of the large primary rear foil, which may facilitate ease of transport and storage. Various quick-release mechanisms may be utilised to achieve this. In some forms locking fasteners may be minimized, if not eliminated, by using spring-loaded latches. Such interfaces may therefore be designed to provide secure unyielding engagements, or may also be designed to automatically disengage if the interface is subjected to a sudden jolt thereby preventing, or at least minimizing, possible structural damage.

In some preferred embodiments of the present invention, a quick-release interface may include an unyielding bayonet interface, preferably a wedge-type bayonet interface, whose male and female counterparts are locked securely by at least one bolt to the primary rear foil. Although this locking method is not meant to be limiting and may include alternative locking devices such as quick release pins or clips or the like. In such embodiments, the rear foil has a recess on its top midsection into which a mounting plate is installed. The top mounting plate is secured with bolts or other appropriate fasteners inserted from the bottom of the rear foil. This top mounting plate is preferably in the form of a female bayonet mount.

The top mounting plate may function as the female half of the bayonet interface that interlocks with the lower end of the rear strut. In the preferred embodiment, an intermediary upright member is incorporated and bolted to the lower end of the rear strut. Thus, the intermediary upright member is located between the top of the rear foil and the bottom of the rear strut. It will be appreciated that the lower end of this intermediary upright member bears the matching male half of the bayonet interface and shall be referred to as the male bayonet mount. The intermediary upright member is optional and therefore not meant to be limiting. If not present, the lower end of the rear strut shall be formed as the matching male half of the bayonet interface or otherwise configured to connect to the rear foil, preferably in a removable fashion.

If present, the intermediary upright member can be easily replaced should its male bayonet interface be worn or damaged, therefore increasing the longevity of the bike frame. Furthermore, a predetermined failure point can be engineered somewhere along the intermediary upright member to allow it to bend or break should the rear foil be subjected to overwhelming structural loads, such as what can be expected from a severe ground strike. Damage limitation is achieved by allowing this male bayonet mount to partially fail or to fully break so that the rear foil or the bike frame itself are spared from serious or irreparable structural damage, therefore minimizing repair costs. It will be appreciated that a damaged male bayonet mount that has fulfilled this function should not be repaired, and needs to be replaced with a new unit. Similarly, the top mounting plate of the rear foil can be easily replaced if its female bayonet interface gets worn or damaged, thereby increasing the longevity of the rear foil. However, this mounting plate does not require an engineered failure point.

Both male and female bayonet mounts in the preferred embodiment are made from aluminium but they can also be made of other materials suitable for such applications. As will be understood by one skilled in the art, in alternative arrangements, the top mounting plate may be formed as a male bayonet mount and the intermediary upright member, if used, or the lower end of the rear strut may be formed as the female bayonet mount.

In preferred embodiments of the invention, the front foil does not require an interface such as a bayonet interface. The front foil does not have a recessed top midsection as this would compromise the strength of its profile (which is relatively thin due to its smaller size). Instead, the front foil interface may utilize a spacer/connector that functions as a flange to widen the effective base area of the front strut. This front strut connector is located and clamped in between the bottom end of the front strut and the top midsection of the front foil. This is achieved by inserting bolts or other appropriate fasteners from the bottom of the front foil into attachment points at the lower end of the front strut and then tightened.

In alternative embodiments of the present invention, the top midsection surfaces of the front and/or rear foils may be configured as an integrated protrusion rising upward to form a strut or a portion of a strut profile, the upper ends of which are attached or otherwise have removable engagement features with the appropriate front or rear section of the frame. It will be understood that these are just examples of the ways in which the foils may be mounted to the bike and are not meant to be limiting. Persons skilled in the art will appreciate that the foils may be mounted to the bike in a number of ways through the appropriate use of fasteners, apertures, recesses and/or housings or any combination of these. This ability to allow the foils to be attached and/or detached relatively quickly provides the user with the ability to operate, transport, store and maintain the bike in an efficient and convenient manner.

Steering Assembly

The bike should be understood to have a steering assembly, which can be manipulated by the user while the bike is in motion. This allows a user to control the general path of travel of the bike as well as allowing the user to balance the bike when starting from a stationary and submerged position.

In preferred embodiments of the invention, the steering assembly is associated with the front section of the bike. As noted previously, a vertical front strut is connected to the lower end of the front section. The front foil is mounted transversely to the lower end of the front strut. It is to be understood that the entire front foil and most of the front strut is positioned under water while the bike is in cruising condition.

The substantially vertical front section of the frame incorporates a fixed head tube upon which the steering assembly derives its orientation. The steering assembly includes a steering fork. In some embodiments, the steering fork is comprised of a substantially vertical steerer tube with a forward facing elongated horn formed at the base. The end of the forward facing fork horn has a transverse mounting aperture upon which the upper end of the front strut is pivotally attached.

Although intrinsic to the steering assembly, the forward-aft pivoting motion of the front strut is preferably only utilised to directly alter the angle attack of the front foil as described in the following tiller section. Consequently, this fully independent motion does not cause the front strut to produce a steering effect.

The steering fork is inserted inside the frame head tube and allows the steering fork to rotate in a secured manner, whereby the fixed head tube of the frame and the rotating steerer tube inserted therein, share the same central axis between their respective upper ends and lower ends.

In preferred forms, a handlebar is attached to the upper end of the steerer tube of the steering fork. The handlebar actuates the steerer tube to rotate about its central axis, which causes the fork horn at its base to move from left to right, in a side-to-side arc motion. As a result, the fork horn will move the front strut in direct synchrony with the movement of the handlebar. Therefore, the front strut effectively acts as a rudder, allowing the user to control the direction of travel of the bike.

In preferred embodiments, the handlebars are attached to an intermediary and substantially horizontal stem, which in turn is attached to the upper end of the steerer tube. The stem can come in a range of lengths so the handlebars can be customized to the user's preference in reach. This method of attaching handlebars is also used for conventional bicycles, and thus suitable handlebars and stems may be readily sourced from manufacturers of conventional bicycles and may be used with minimal or no modifications.

However, this is not meant to be limiting and other ways of mounting handlebars to the steerer tube are envisaged. For example, the handlebars may include a clamping mechanism that fits directly about the upper end of the steerer tube without the need for a stem. Other alternative configurations to mount handlebars can be achieved in a number of ways readily apparent to persons skilled in the art.

The handlebars and therefore the steering fork itself are configured to have a restricted range of movement which may be referred to as a steering arc. The steering arc should be understood to mean the extreme limit of the range of movement that may be achieved when turning the handlebars side to side. It is not desirable to have an unrestricted steering arc as an abrupt or otherwise significant and uncontrolled change of direction can result in loss of frontal lift generated by the front foil. The laminar flow of fluid above and below the front foil must remain substantially perpendicular to the span of the foil while cornering.

In preferred embodiments of the invention, a steering lock is employed to restrict the steering arc. In its simplest form, the steering lock is achieved by creating a protrusion whose travel path fits into or within the limited confines of a recessed area. The protrusion may be part of the steering fork and the recessed area located at a fixed portion somewhere at the front section of the frame—or vice versa. Preferably, the steering lock is provided at the rear lower end of the head tube but may be positioned elsewhere. Other ways of restricting the steering arc will be readily apparent to persons skilled in the art.

The forward facing fork horn at the base of the steering fork is configured to pivotally engage the upper end of the front strut such that some swinging movement of the strut is permitted, together with the foil attached thereto. This movement is about a generally forward-aft horizontal transverse axis, such that the foil can be inclined or declined to increase or decrease its angle of attack.

It is not desirable for the front strut to have an unrestricted swinging arc as an abrupt or otherwise significant and uncontrolled change of direction can result in extreme negative and positive angles of attack by the front foil. This would potentially cause the bike to nose dive aggressively, or make the front wing to tilt upwards excessively causing it to lose lift and begin to act as a drag brake, or an unsustainable severe rate of climb that induces a speed stall.

The front strut has a pivot-junction formed at its upper end. It is to be understood that the pivot-junction is a bracket that may be utilized to provide a pivotal attachment to the steering fork, and to connect the upper portion of the front strut to the forward facing tiller arm. The pivot-junction may have a cavity or recess in which the fork horn is inserted and pivotally connected by a transverse pin or axle. Consequently, the fitment between the fork horn and the pivot-junction recess may be configured in such a way that a predetermined swing arc restriction for the front strut is established. The swing arc restriction of the pivot-junction is therefore directly associated to the pivotal forward-aft movement of the lower end of the front strut.

However, it should be appreciated that the above pivotal configuration for the steering fork and front strut is not meant to be limiting. For example, in other embodiments, the fork horn at the base of the steerer tube may be formed to contain a cavity or recess into which the pivot-junction is inserted and pivotally attached. The swing arc restriction derived from the pivot-junction configuration is also directly associated to the pivotal up-down movement of the tiller arm. In the preferred embodiments of the present invention, the restricted range of pivotal movement of the front strut may also be referred to as the tiller arc.

Tiller Module

The steering assembly may also include a tiller module. A tiller module should be understood to mean a structure that extends forward of the front section of the bike and provides a means of actuating the front strut to produce an automatic self-correcting pitch and elevation control for the front foil.

In preferred embodiments, the tiller module has a forward-extending tiller arm. The tiller arm is arched or bowed downward towards the front end, although this is not meant to be limiting. A tiller arm may be configured to be straight, or may have one or more bends to form a complex shape. The tiller module has a tiller head at the leading end of the tiller arm. The tiller head may be a simple skid plate, a streamlined bulb or nose cone with a suitable shape to glide below and/or along the surface of the water, or another miniature pivoting tiller mechanism to constitute a compounded tiller module.

The tiller head has a travel path that maintains a constant elevation in relation to the water surface. The travel path of the tiller head may be below or along the surface of the water. The responsive travel path of the tiller head governs the upward or downward orientation of the tiller arm. The resulting pivotal movement of the tiller arm, is also referred to as the tiller arc.

In preferred embodiments, a pivot-junction bracket is present to unify the upper end of the front strut and the rear end of the tiller arm, such that they have a common axis of movement. Therefore, the tiller arm actuates the front strut in synchrony. The tiller module and the front strut (and therefore the front foil) is effectively a unitary assembly, which shares a common transverse pivoting axis affixed at the end of the fork horn.

In use, the tiller head seeks to maintain a constant elevation relative to the water surface when in cruising orientation. If the front foil is traveling too low due to insufficient lift associated with low speeds, the orientation of the tiller module will migrate to an incline. As the front strut moves in synchrony with the tiller module, the front foil will assume a positive angle of attack, automatically self-adjusting to increase its elevation.

Conversely, if the front foil is traveling too high due to too much lift associated with high speeds, the orientation of the tiller module will migrate to a decline. As the front strut moves in synchrony with the tiller module, the front foil will assume a negative angle of attack, automatically self-adjusting to decrease its elevation.

Thus, the tiller module provides one form of a control system for actuating the front strut to produce an automatic self-correcting pitch and elevation control for the front foil.

However, it should be appreciated that a tiller module can also extend backwards from the front strut, i.e. towards the rear strut and rear foil. Those skilled in the art will understand that a backward-facing tiller module may require countermeasures to restore the correct synchronicity to appropriately change the angle of attack of the front foil in relation to the upward and downward movement of the tiller arm. A backward-facing tiller module may also include a tail-fin at the trailing end of the tiller arm. Similar to a leading tiller head, a trailing tiller tail-fin may be a simple skid plate, a streamlined bulb or cone with a suitable shape to glide below and/or along the surface of the water, or another miniature pivoting tiller mechanism to constitute a backward-facing compounded tiller module.

The tiller module can be made completely rigid or partially flexible. For example, the tiller module as a whole or in part, may be formed from a plastic material having a shape memory. Therefore the tiller module may be deformed upon the application of force to an area of the tiller module, but restores its shape when force is removed. It will be appreciated that the plastic material would need to have an appropriate amount of elasticity and resilience to both be deformable and still be able to maintain a measure of structural rigidity, such that the tiller module can operate properly. An arched tiller arm, or one that has one or more bends that form a complex shape, may help attain this precondition accordingly.

Tiller Manual Override

In some embodiments of the present invention, the steering assembly may include an actuator which is operable by the user to adjust the angle of attack of the front foil (i.e. to incline or decline of the foil from its default bias). This allows the front foil trim orientation to be manually manipulated as required. A tiller manual actuator can be fashioned in a variety of ways that will readily be apparent to persons skilled in the art. The tiller manual actuator provides the user with an option to partially influence or completely override the automatically self-correcting trim attributes of the vehicle.

In these embodiments, the actuator can be a lever or a twist-grip device, mounted to the handle bars, to which one end of a flexible wire cable, linkage, or the like is connected. However, this is not meant to be limiting and the actuator may take other forms and be positioned elsewhere on the frame. For example, it may be arranged to be operative upon the rear foil, either individually or in combination with the front foil. Of course, it will be understood that the rear foil, or a section of the rear foil, or an integrated mechanism such as a flap on the rear foil itself, will need to be mounted to the rear section of the frame in such a way as to allow pivotal movement about a transverse horizontal axis.

Drivetrain Assembly

The bike includes a drivetrain assembly which transfers the energy of the user (and/or some other power source (e.g. electric motor) to a propeller (or other prime mover) to create propulsion. Thus, it will be appreciated that in preferred embodiments of the present invention the various subsections of the drive mechanism work together in series to provide a drive train. At the forefront of the drivetrain assembly a typical bicycle pedal/crank mechanism may be utilised to harness pedaling motion in order to rotate a propeller to produce thrust. The drivetrain assembly may also be reconfigured to drive water jet impellers, or compounded multiple propeller set-ups (and/or other prime movers).

In the preferred embodiment of the invention, the drivetrain assembly utilizes a hybrid combination of both 'chain-driven-sprocket-wheels' and 'gearbox-unit' power transmission methods, although this is not meant to be limiting. A drivetrain assembly may be configured to utilize a singular power transmission method exclusively. Advanced configurations may also have sprocket-shifting or gear-changing mechanisms that can adjust drive-ratios while the bike is in operation. Drive ratios may also be adjusted by utilizing a stepless transmission assembly or CVT (continuously variable transmission). In the preferred embodiment of the invention, the drivetrain assembly is comprised of two subsections; the drive mechanism—and the gearbox units.

In one configuration, the drive mechanism subsection is comprised of a drive-wheel activated by foot pedal cranks, a driven-wheel, and a continuous flexible linkage. In the preferred embodiment of the invention, the continuous flexible linkage is a conventional bicycle roller-chain with a plurality of individual links, associated with a drive sprocket-wheel, a driven sprocket-wheel, and an idler sprocket-wheel that provides tension adjustment for the roller-chain. The driven sprocket-wheel is directly connected to—and therefore drives the gearbox unit subsection behind it. It will be appreciated that given the environment in which the bike is to be used, a suitable roller-chain with anti-corrosive properties may be used. However, it is not beyond the scope of the present invention that the continuous flexible linkage is in the form of a flexible toothed belt, associated with a toothed drive-pulley and a toothed driven-pulley.

In preferred embodiments of the invention, the drive sprocket-wheel may be removable and interchanged with readily available conventional bicycle sprockets of various sizes, also known as chainrings. The ability to interchange the chainrings may be useful in optimizing propeller performance with users of varying strength and fitness levels. The chainring is associated with a generally transverse horizontal axle passing through an aperture across the bike frame. Crank arms which lead to the foot pedals are connected at either end of the axle. The axle governs the axis of rotation of the chainring, and will be referred to as the crank axle.

The crank axle is configured to pass through a complementary aperture in the appropriate section of the bike frame, typically at or near the bottom bracket. The bottom bracket of the bike frame supports and secures the crank axle axis of rotation via metal ball bearings or metal needle bearings on either side, but this is not meant to be limiting. Flanged bushings made of non-ferrous, ceramic, plastic or other low-friction materials may be utilised instead.

In preferred embodiments, the bottom bracket (and thus the drive mechanism) is associated with the rear section of the frame. However, it is not beyond the scope of the present invention that the drive mechanism is associated with the front section of the frame rather than the rear. For example, the bike may be relatively reclined to place the user in either a recumbent or a prone position. It will be appreciated that this may mean that the geometry and placement of the drive mechanism and propeller assembly may be suitably arranged to allow this.

The chainring includes a means by which it can be rotated. In preferred embodiments, the chainring includes a pair of cranks and pedals, one for either foot of the user. It will be appreciated that the reciprocating upward and downward motion of the user's legs is converted into the rotational movement of the chainring. However, in some embodiments of the invention, the crankarms of the drive mechanism may be customized to include or be connected to a pair of oscillating levers or the like which may be actuated by the user's arms in a manner similar to a hand cycle—or actuated by the user's legs, in a manner similar to a fitness step machine. Oscillating levers can also be activated by a combination of both arm and leg movements. It will be appreciated that the geometry of the drive mechanism and propeller assembly may need to be suitably configured to allow this, in a manner that will be readily apparent to persons skilled in the art.

In the preferred embodiment, the drivetrain assembly also includes a consecutive subsection comprised of two gearbox units. The driven sprocket-wheel drives an upper gearbox unit (above water) that is connected to a second gearbox unit (below the water) via a rotary drive shaft running parallel and behind the rear strut. However, this is not meant to be limiting as the rotary driveshaft may be positioned ahead of, or mounted inside the rear strut.

The upper gearbox unit is preferably mounted via a gusset plate proximate to the bottom bracket which is located in the portion of the bike frame that operates above the surface of the water. However, this is not meant to be limiting and other ways of mounting the upper gearbox unit will be readily envisaged.

The lower gearbox unit is preferably mounted to the lower trailing end of the rear strut which houses the propeller assembly, and shall therefore typically operate underwater. In preferred embodiments of the invention, it will be appreciated that the portions of the drivetrain assembly that remain underwater at cruising speeds are preferably covered by a streamline cowling for protection, drag reduction, safety and aesthetics.

Both gearbox units (containing bevel gears) transmit the drive power to the propeller in the correct rotational direction, as required to actuate the propeller assembly correctly. The sizes of the internal bevel gears in this subsection, in conjunction with the sprocket-wheel sizes of the preceding drive mechanism subsection, produce the appropriate drive ratio output by the drivetrain assembly. The appropriate pedal-to-propeller drive ratio is dictated by the type, pitch and RPM rating of the propeller design.

The gearboxes are connected by a rotary driveshaft whereby the upper gearbox can transmit drive power to the lower gearbox. Preferably, the rotary driveshaft is connected to the gearboxes via spline interface connections or the like.

Additionally, it is not beyond the scope of the present invention that the drivetrain assembly is associated with an electric motor or a combustion engine or the like (for use alone and/or in combination with pedals or other human power input). However, in such an embodiment, the motor and its location would need to be appropriately adapted to operate in the environment in which the invention is to be used. For example, an electric motor may be introduced at the beginning, in the middle, or at the end of the drivetrain assembly. In the latter situation, the electric motor is integrated into the propeller assembly itself in such a way where its power output by-passes the drivetrain assembly altogether, and is transmitted directly to the propeller. However, the drive connection between the pedal-powered drivetrain assembly and the motor-driven propeller assembly is upheld in a manner whereby a pedal-assist condition is created. The user can assist the motor in order to extend battery life, or the motor can be activated to assist (or take-over completely) in order to preserve the user's energy levels. A pedal-assist drive connection may be achieved by utilizing electronic switch/sensors together with mechanical couplers—such as one-way rotary bearings or ratchet mechanisms.

In another example, an electric motor/propeller unit (or units) can be introduced at any practical location whereby an auxiliary propulsion unit is fully independent from the primary drivetrain and propeller assembly. It is advantageous to have auxiliary electric motor/propeller units electronically programmed so that the auxiliary electric units independent thrust delivery is complementary to the manner in which the primary pedal-operated drivetrain and propeller assembly is being used. Although motorized adaptations (electric or otherwise) is meant to provide a pedal-assist condition to extend the operating range of the vehicle, it is not beyond the scope of the present invention to have a fully motorized configuration, where all relevant features or drive assembles necessary for pedaling are excluded.

Propeller Assembly

In preferred embodiments of the present invention, the bike has a propeller assembly, as a form of prime mover, which receives rotational energy from the user via the drivetrain assembly, through the drive mechanism subsection and the gearbox unit(s) subsection. Therefore, the preceding drivetrain assembly transmits rotational energy to the propeller assembly. However, it is not beyond the scope of the present invention that the drivetrain assembly and the propeller assembly is a singular unitary assembly, with a series of various chain-driven sprocket-wheels directly operating the propeller.

The propeller assembly can be understood to have a rear end and a front end. In preferred embodiments of the present invention, the rear end of the propeller assembly is a bearing hub upon which a propeller shaft is securely installed and contained. The propeller assembly has a propeller shaft that rotates along the central axis of a bearing hub with a longitudinal horizontal orientation in relation to the bike frame. The propeller shaft protrudes past the front end of the hub, onto which a propeller is connected. In preferred embodiments of the present invention, the bearing hub of the propeller assembly is associated with rear section of the bike frame in such a way that the bearing hub can pull the rear section of the bike forward.

The hub itself may utilize ball bearings, but could also include alternative bushings with flanges to provide a lip about its apertures. The bearing hub of the propeller assembly is connected to a corresponding aperture at the rear section of the frame. This frame aperture shall now be referred to as the thrust-tube, and should be understood to have a front end and a rear end. The thrust-tube may have a circular cross-section but this is not meant to be limiting as other polygonal or other cross-sections may be utilized. In preferred embodiments of the present invention, the thrust-tube has a rectangular cross-section.

In the preferred embodiment of the invention, the frame thrust-tube is located below the water level, adjacent to the lower end of the rear strut and above the rear foil, but this is not meant to be limiting. The thrust-tube may be located elsewhere on the rear strut, or on the rear foil itself. Preferably, the thrust-tube centerline (and therefore the axis of the propeller) is positioned substantially higher than the chord of the rear foil, such that the rear foil itself can protect the propeller blades from ground strikes.

The thrust-tube location along the rear strut determines the position of the propeller in relation to the water surface. In addition, the intended length of the bearing hub will determine the actual forward location of the propeller in relation to the rear strut. The location of the propeller must be deep enough so that its blades do not break above the water surface, with sufficient distance to clear other parts of the bike, as well as the user.

In preferred embodiments, the propeller is located in front of the rear strut of the frame and the leading edge of the rear foil. The propeller may be located between the front and rear foils. The propeller is preferably positioned above the height of the rear foil so when the hydrobike is place of a surface out of the water (e.g. placed on land) the propeller blades will not touch the surface. This arrangement for assists in protecting the propeller blades from ground strike damage and allows the bike to easily stand upright on a horizontal ground surface, such as when being serviced or otherwise not in use. Alternatively the propeller may be positioned in line with the rear foil. In such arrangements, the rear foil may be coupled to or include one or more struts or support that extends below the rear foil to protect the propeller blades from ground strikes when placed upon a surface out of the water. Alternatively, the hydrobike may be positioned on a structure or stand when out of the water to assist in preventing components such as the propeller blades from being damaged.

In preferred embodiments, the propeller faces forward such that the thrust tube and propeller shaft therein are located behind the forward facing propeller. In the preferred embodiment of the invention, the lower gearbox is mounted securely into the rear end of the thrust-tube. Whereas, the bearing hub of the propeller assembly is threaded securely to the front end of the thrust-tube.

The propeller shaft revolves along the central axis of the bearing hub, whereby the propeller shaft extends out in front of the hub and also behind the hub. The rear end of the propeller shaft protruding behind the hub is oriented to be in-line with the forward facing axle of the lower gearbox. The front end of the propeller shaft protrudes in front of the hub and is oriented to be attached to the propeller. The propeller is understood to pull the propeller shaft and its bearing hub (and thus the entire bike) forward along with it.

The lower gearbox has a forward facing axle with a spline interface or the like, that provides a matched coupling with the rear end of the propeller shaft. The axle-to-shaft coupling between these two parts occurs inside and along the centerline of the thrust-tube. It is to be understood that in this arrangement the coupling permits the gearbox axle and the propeller shaft to slide in and out freely from each other, even while rotational drive forces are applied. However, this free-sliding coupling is held securely in place by the structural restriction created when the lower gearbox and the propeller bearing hub arc securely attached to the thrust-tube.

The lower gearbox typically has two beveled spur gears including a drive gear and a driver gear, with the drive gear rotating about the mostly vertically oriented rotary drive shaft. The driver gear could be located in a plane mostly above or mostly below the central axle of the propeller shaft. Teeth on the beveled drive gear mesh with teeth on the driver gear to transmit rotational shaft power form the rotary drive shaft to the propeller shaft.

The bearing hub will bear the full pulling force created by the propeller. Because the hub is directly connected to the frame via the thrust-tube, it will be appreciated that the lower end of the rear strut (and therefore the whole bike) will be pulled forward by the propeller assembly, without transferring any extraneous thrust loads against the lower gearbox axle.

It will be understood that the propeller has blades arising from a central cylindrical boss for the purpose of generating propulsion. The preferred diameter of the central cylindrical boss is approximately 2 inches or 50 mm. Two or more propeller blades may be utilized within a diameter range of approximately 8 to 14 inches (approximately 203 to 355 mm), to rotate clockwise or counter clockwise as viewed from the rear of the vehicle, a right-hand or a left-hand propeller respectively. In some embodiments, the tips of the individual blades may be joined together by a thin strand of material fashioned to extend along the circular travel path of the blade ends—thereby forming a protective ring that resembles the size (diameter) of the propeller. In an alternative embodiment, a fixed static cowling of slightly larger diameter (in order to clear the blades) may be placed adjacent to the blade end paths to form a protective shroud surrounding the propeller.

In a preferred embodiment, the front end of the propeller shaft requires a fastener such as a locknut to stop the propeller from pulling itself off the driveshaft when thrust is produced. Persons skilled in the art know that other fasteners such as cotter-pins, circlips, spring-loaded barbs, or quick-release latches and clamps, and such like can be utilized to secure the propeller, or to secure an ancillary drive-block (if utilized). The front end of the propeller shaft shall have a hexagonal spline or the like, and a threaded section ahead of it. The propeller shaft spline can be coupled directly to a matched aperture along the centre of the propeller, or indirectly, via an ancillary drive-block encapsulated within the cylindrical propeller boss.

In a preferred embodiment, the hexagonal spline of the propeller shaft is connected to an ancillary drive-block with a uniform hexagonal cross-section along the length of its outer perimeter. However, this is not meant to be limiting as any polygonal cross-section, tapered or uniform, may be employed for this purpose. The drive-block fits into a matching internal cavity at the front end of the cylindrical propeller boss.

The drive-block may also be made of semi-flexible material such as rubber, to provide a measure of shock absorption should the propeller hit the substrate or a foreign object while in use. Additionally, the drive-block can be designed to protect and isolate the drivetrain and the user from impact by shearing-off completely along its propeller shaft interface. It should be understood that a self-shearing drive-block needs to be replaced in order to restore normal propeller operation.

The drive-block can also be designed to engage the propeller in accordance to its thrust direction, but moreover also allows the propeller to free-spin in the opposite direction. A one-way free-spinning action incorporated into the drive-block can be achieved by utilizing pawls, wedge mechanisms with roller needles or ball bearings, and clutch or friction mechanisms, and the like.

Such a system may be useful in situations where it is not desirable for a halted propeller to slow down the vehicle, or a reverse rotating propeller to serve as a brake. A one-way spin or unidirectional drive-block is especially useful when the bike is being propelled forward by external environmental conditions, such as strong water currents, wave formations, or tail winds—at a faster pace than what the user is able or willing to match by pedaling.

A nose cone may be utilized to streamline the frontal area of the cylindrical propeller boss. The nose cone may be attached directly to the propeller shaft, or onto the internally located drive-block itself. Because the fastener (e.g. locknut) bears the full thrust load of the propeller, the streamlined nose cone is non load-bearing and can be made of lightweight materials.

In the preferred embodiment of the present invention, the rotational axis of the propeller is positioned substantially higher than the chord of the rear foil, such that the rear foil itself can protect the propeller blades from ground strikes. Additionally, this position also allows the propeller to generate faster water laminar flow over the upper surface of the rear foil directly behind it. This creates a boost in lift especially during low speed acceleration by increasing the pressure differential between the upper and lower surfaces of the rear foil along the central area behind the propeller.

In alternative embodiments, variable pitch propellers may be utilized to maximize high speed efficiency and low speed thrust. In other embodiments, a propeller assembly containing two contra-rotating propellers in tandem may be utilized either collinear or offset. Yet another embodiment may have two identical propeller assemblies attached to either side of the rear strut, rotating in opposite directions.

In other alternative embodiments, a propeller assembly with variable axis of rotation may be utilized, whereby the thrust direction of the propeller may be substantially redirected downward in order to produce lift. When launching from a submerged stationary position, this thrust-vectoring principle may be adopted to augment or even replace any in-built buoyancy characteristics of the hydrofoil bike. The propeller assembly shall therefore be purposely oriented to create a progressive transition, from producing lift initially to eventually producing rearward thrust. It will be appreciated that the propeller axis of rotation shall be redirected to propel the bike forward as soon its foils begin to generate adequate lift. Singular or multiple propeller assemblies utilized for thrust-vectoring may or may not be directly coupled to the drivetrain assembly. Motorized auxiliary thrust-vectoring propeller assemblies (or jet-stream nozzles) for example may be introduced at any practical location on the bike that is fully independent from the primary drivetrain and propeller assembly.

It will be appreciated by persons skilled in the art that the structure of the frame and rear strut may have to be rearranged in order to accommodate these variations or combinations of these variations, and to ensure that the propeller blades do not come in contact with any part of the bike or user. It will also be appreciated that this aspect of the invention may also be used with more conventional hydrofoil bikes, rather than the preferred embodiments described herein.

In preferred embodiments of the invention, the hydrofoil bike is formed from a range of modular components. The modular components may include one or more of the hydrofoils, buoyancy modules, steering assembly, tiller module, drivetrain assembly and propeller assembly or groups of two or more of these components. The modularity of the components offers the user with the ability to customize the entire bike.

Using the Hydrofoil Bike

Operating the hydrofoil bike is an acquired skill. The hydrofoil bike may be launched in two different ways; or from a structure above water such as a jetty or dock; from a stationary fully or substantially submerged starting position (where the user has remounted the bike after being separated from the vehicle in open water).

In the former situation, launching from a structure above the water, the launch begins from a jetty or docking structure with sufficient clearance between the surface of the water and the substrate bed directly below; otherwise the user and the bike may make heavy contact with the substrate during launching.

The user stands and lowers the rear foil and propeller into the water right below the jetty edge while holding onto the handlebars. The bike is outward bound with a nose-up orientation such that the front foil hangs above the water. The user in momentary balance, stands with one foot on the jetty, and prepares to place the other foot onto the preferred leading pedal of the bike. In one fluent motion, the user lunges forward by pushing-off with one foot on the jetty while simultaneously transferring body weight onto the leading pedal and lowering the handlebar and front foil onto the water.

The user sits on the seat or saddle and pedals immediately to rotate the propeller and generate forward propulsion. Even though the bike and user sinks momentarily, as long as the propeller produces a progressive rate of acceleration from a standing start, the foils will generate the lift necessary to elevate the user and the bike above the water and a cruising condition is attained.

In the latter situation of launching from a stationary fully or substantially submerged position, the user swims next to the semi-buoyant bike and re-orients it to an upright and substantially horizontal position. The exact method of remounting the bike whereby the user can eventually stand over the pedals with both feet as the semi-buoyant bike is pushed lower and completely underwater, depends largely on learned skill and preferred approach which may vary from person to person. Starting from this state of stationary equilibrium (the user's head and shoulders above water) pedaling motion is applied until enough forward momentum is progressively achieved so that the foils create sufficient lift to raise the bike and user out of the water.

In summary, it will be appreciated that the present invention provides a number of advantages over prior art devices, as discussed throughout the preceding section of the specification. Essentially, these include:

- ease of assembly and disassembly;
- purposely designed for practical transport and storage;
- modular construction facilitates easy and cost-effective repair and maintenance;
- modular construction provides an infinite upgrade-path to avail of improved, preferential, or specialized performance capabilities;
- buoyancy elements allow the bike to have at least slightly positive buoyancy to avoid sinking and to assist in deep water restarts, while still being streamlined in form to minimize drag;
- able to be launched, or as the case may be re-launched in open water from a submerged stationary position;
- sturdy construction and strategically placed engineered failure-points limits bike damage should it come into contact with submerged objects and terrain; or
- at the very least, offers the public a useful choice.

BRIEF DESCRIPTION OF DRAWINGS

Further aspects of the present invention will become apparent from the following description which is given by way of example only and with reference to the accompanying drawings in which:

FIG. 3 is a perspective view of an embodiment depicting the preferred hydrofoil arrangement that is a canard configuration;

FIG. 3A is the cross-section profile of a supercritical-type foil specifically developed for an exemplary embodiment of the present invention;

BEST MODES FOR CARRYING OUT THE INVENTION

Figure 1:
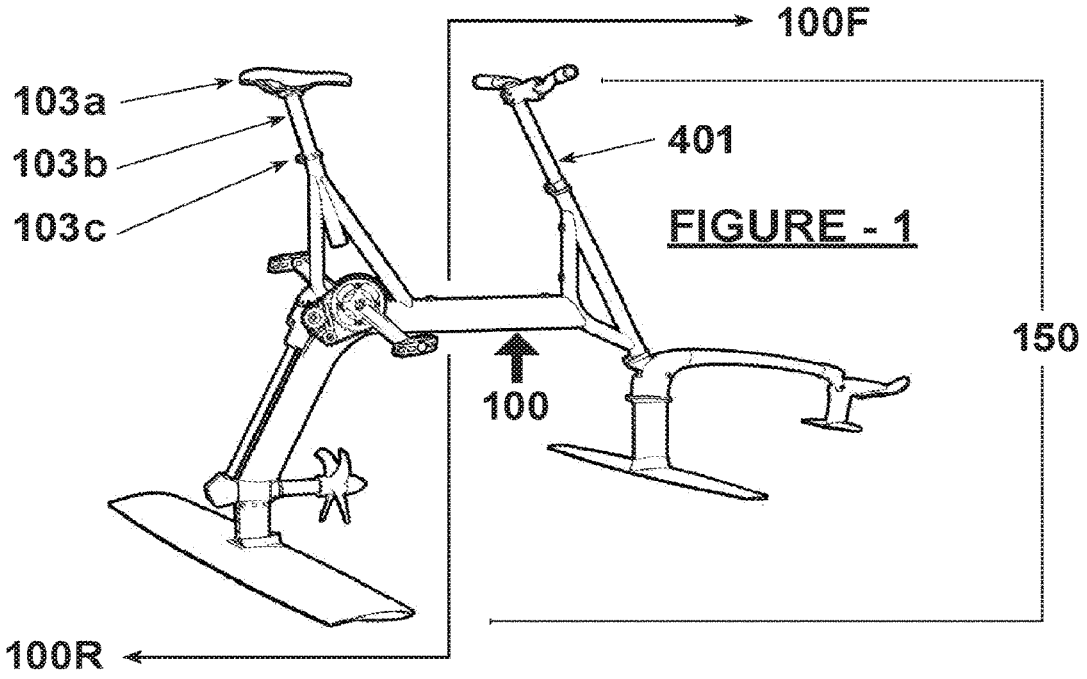
FIG. 1 is a perspective view of an exemplary embodiment of a hydrofoil bike.

FIG. 1 depicts an exemplary embodiment of a hydrofoil bike (150) whereby all of its various assemblies and components are attached to its main frame (100). Generally the hydrofoil bike is subdivided into two sections—the front section (100F) wherein the steering and pitch/elevation of the vehicle is controlled; and the rear section (100R) from which the vehicle derives its mode of propulsion and its substantial source of lift.

Figure 1A:
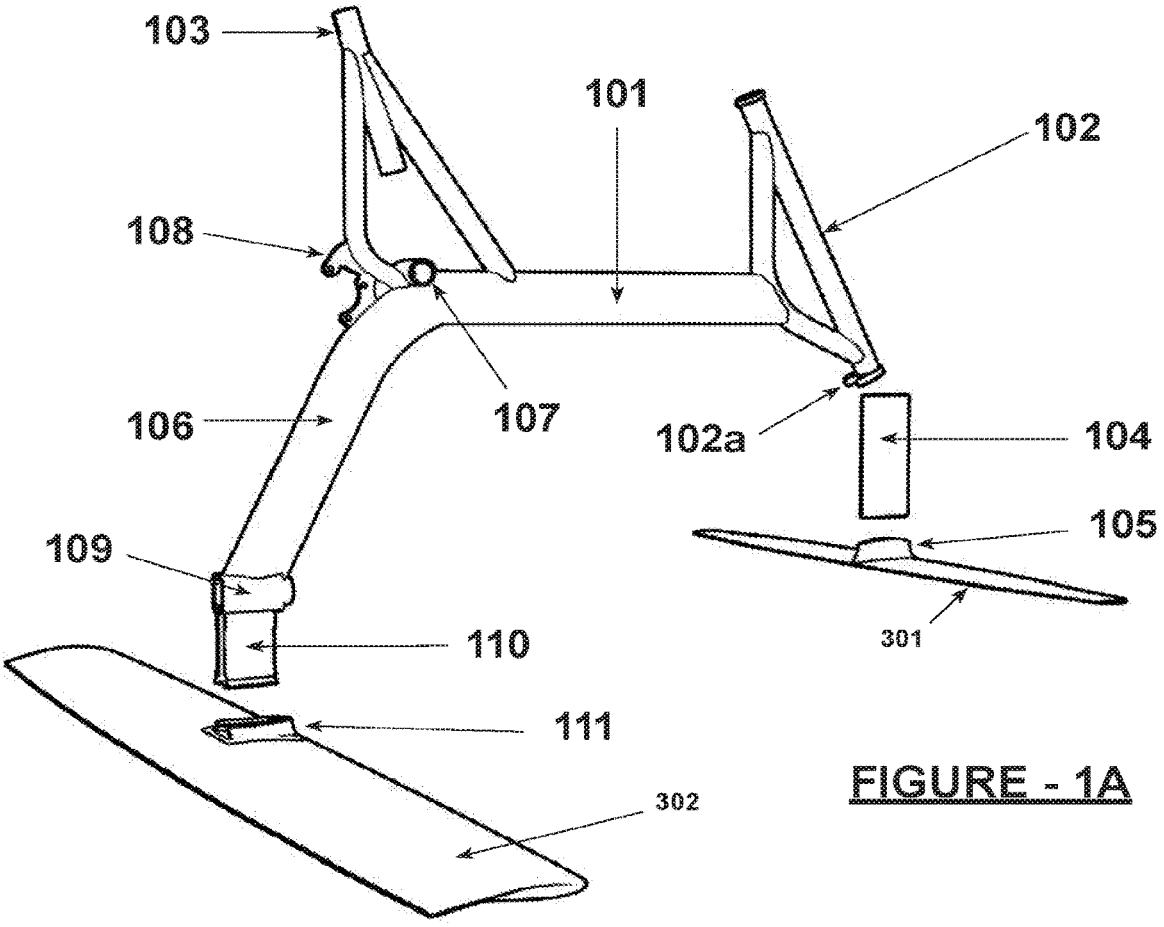
FIG. 1A is a perspective view of a bare frame depicting the strut extents and the position of their respective hydrofoils exploded therefrom.

The various parts of a preferred embodiment of the main frame (100) are depicted in FIGS. 1 and 1A. A horizontal member (101) of the main frame (100) connects the front section (100F) and the rear section (100R) together. The steering fork (401) (also seen in FIG. 4A) derives its orientation from the head tube (102) which also restricts the side to side movement of the fork (401) via a restrictor slot (102*a*).

A typical bike saddle (103*a*) is conventionally attached to a typical seat post (103*b*) which is then inserted into the seat tube (103) that forms an adjustable telescopic interface. The position of the seat post (103*b*) is secured by a seat clamp (103*c*) clasping the upper end of the seat tube (103) of the bike frame (100).

The overall configuration of the main frame (100) includes a front strut (104) and a rear strut (106). The front strut (104) is also part of a steering assembly (400) (seen in FIG. 4) and is therefore a reactive structural member with variable orientation in relation to the bike frame (100). The rear strut (106) is a fixed structural member of the bike frame (100) which extends downwards from a bottom bracket tube (107) and the horizontal member (101). The horizontal and transverse orientation of the bottom bracket tube (107) has apertures at both sides, upon which the drive-mechanism (601) (seen in FIG. 6A) is integrated.

A thrust tube (109) is located at or near a bottom end of the rear strut (106). The horizontal and longitudinal orientation of the thrust tube (109) has a front end, upon which the propeller assembly (700) (seen in FIG. 7) is integrated in this exemplary embodiment. A mounting gusset (108) is located behind and adjacent to the bottom bracket tube (107). The mounting gusset (108) and the rear end of the thrust tube (109) are both mounting points, upon which gearbox unit (sub-section (602) seen in FIG. 6A) is integrated.

Figure 1B:
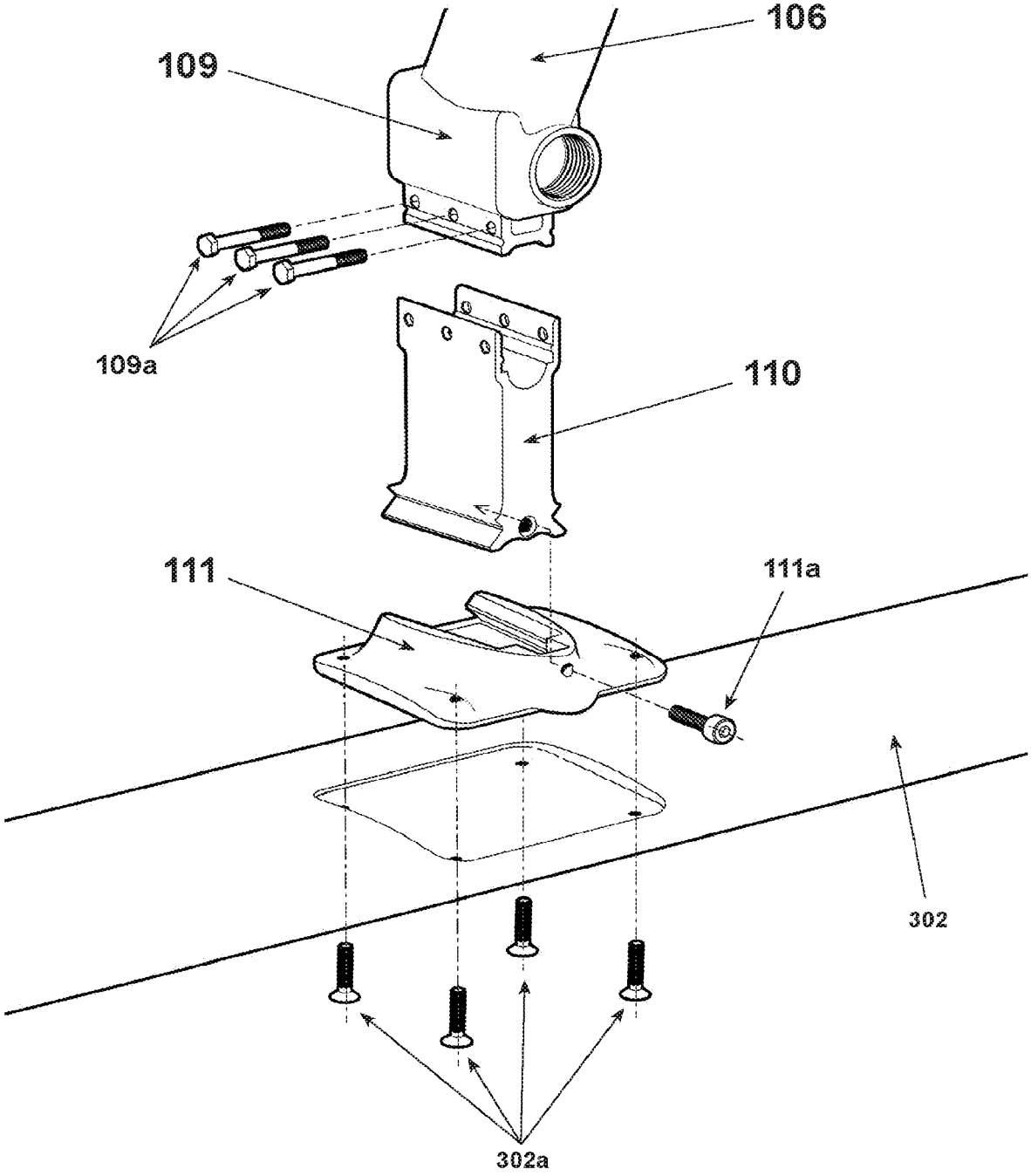
FIG. 1B is a perspective drawing of a preferred embodiment of an intermediary bayonet-mount to connect the rear foil to the frame.

An intermediary vertical member (110) is located between the bottom of the thrust tube (109) and an upper midsection of a rear foil (302). The top end of the vertical member (110) is integrated securely onto the bottom of the thrust tube (109) via appropriate fasteners (109*a*) as depicted in FIG. 1B, thereby becoming a unified structural extension of the rear strut (106) of the bike frame (100).

The bottom end of the vertical member (110) is fashioned to have a male bayonet shape which provides a quick-release interface when connected to its female bayonet counterpart or shoe (111) and is locked securely in place by one bolt (111*a*). This female bayonet shoe (111) is likewise integrated onto the upper midsection of the rear foil (302). Appropriate fasteners (302*a*) inserted from the bottom of the rear foil (302) midsection are tightened against threaded areas at the bottom of the female bayonet shoe (111). This exemplary rear interface between the frame (100) and rear foil (302) allow for modularity to facilitate disassembly for storage, transport, repair, swapping of parts for performance adjustment, etc.

The bottom end of the front strut (104) has an intermediary flange or front strut shoe (105) that provides a wider footing to allow a more secure connection for a front foil (301). This flange or front strut shoe (105) is clamped in between the bottom of the front strut (104) and the upper midsection of the front foil (301). As shown in FIG. 5A, appropriate fasteners (301*a*) are inserted from the bottom of the front foil (301) midsection, and are tightened against threaded areas at the bottom end of the front strut (104). This exemplary front interface can similarly allow for removal of the front foil (301) from the frame (100) to facilitate modularity as discussed above.

Figure 2:
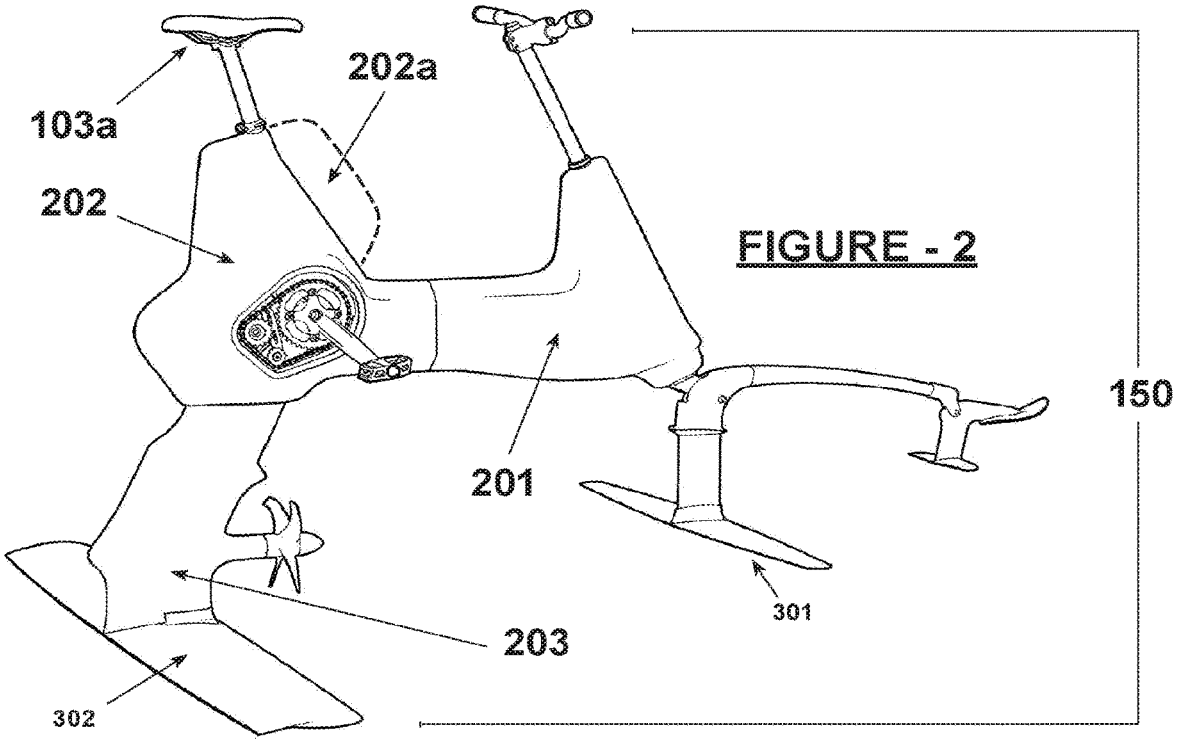
FIGS. 2 & 2A are perspective views of an exemplary embodiment of a hydrofoil bike with buoyancy modules.

FIG. 2 depicts a perspective view of an exemplary embodiment of a hydrofoil bike (150) with buoyancy modules (201 and 202). Although the preferred embodiment is separated into a front module section (201) and a rear module section (202), a singular unified buoyancy module (not shown) may also be adopted. The illustration continues to show a streamlined strut cowling (203) that covers a lower half of the gearbox unit subsection (602) (as seen in FIG. 6A), the rear strut (106), the thrust tube (109), and the bayonet upright member (110) below it (as shown in FIG. 1A).

An optional storage module (202*a*) is preferably located at the front of buoyancy module (202) and below the saddle (103*a*). This module may be utilised as a storage area, or may house a battery if an electric motor is installed. Alternatively, the area may be allocated for attaching a drinking bottle. However, this is not meant to be limiting as other locations around the hydrofoil bike (150) may be utilised for this purpose.

Figure 2A:
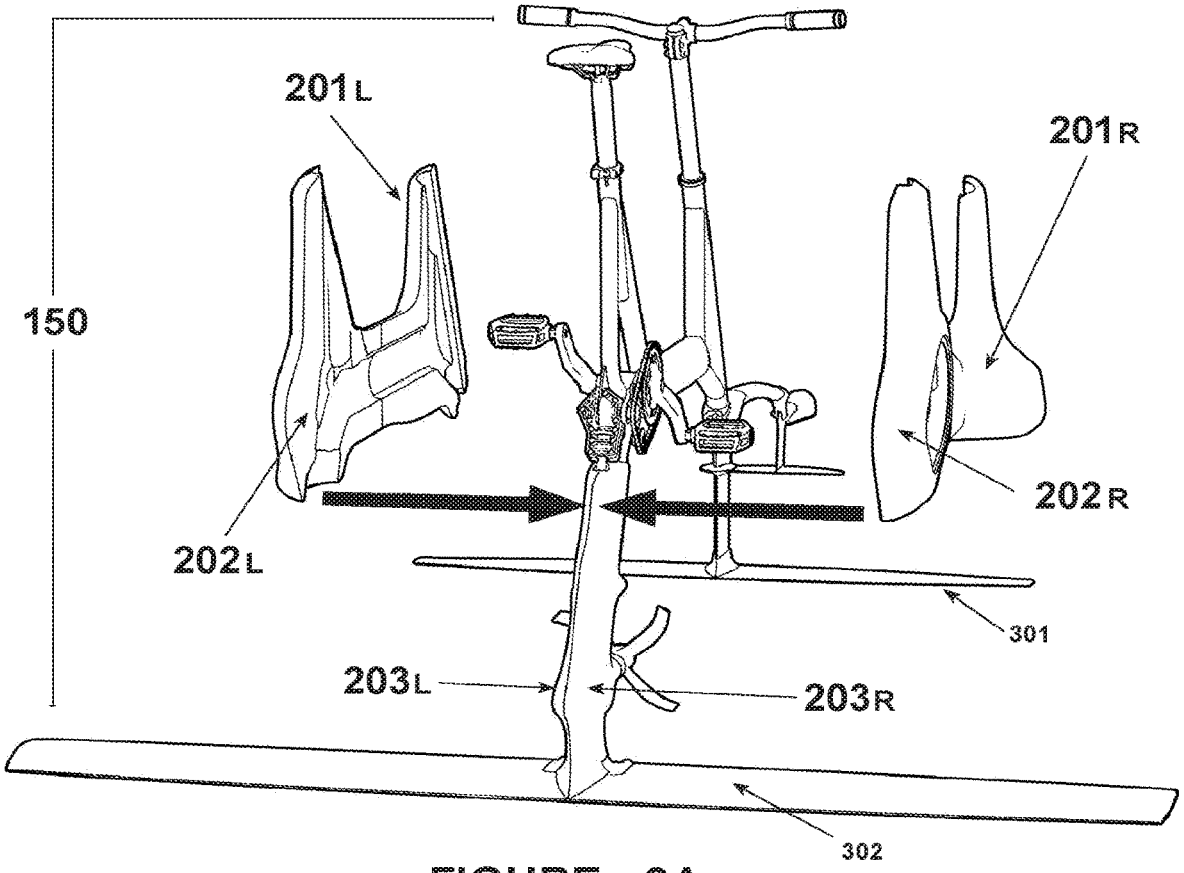
Figure 2B:
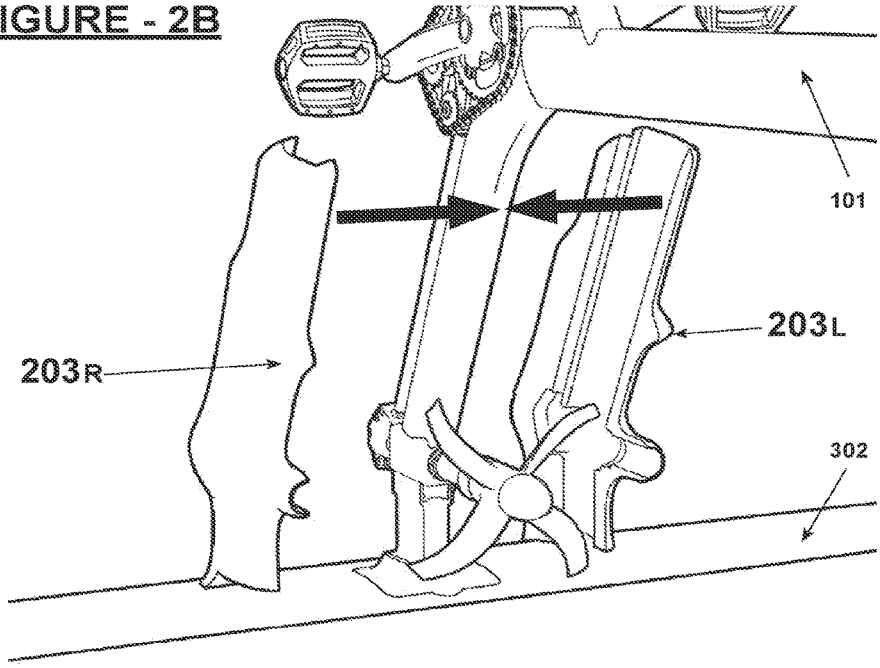
FIG. 2B is a perspective view depicting an exemplary propeller cowling that provides a streamlined and buoyant covering that encapsulates the rear strut and lower drivetrain.
Figure 9:
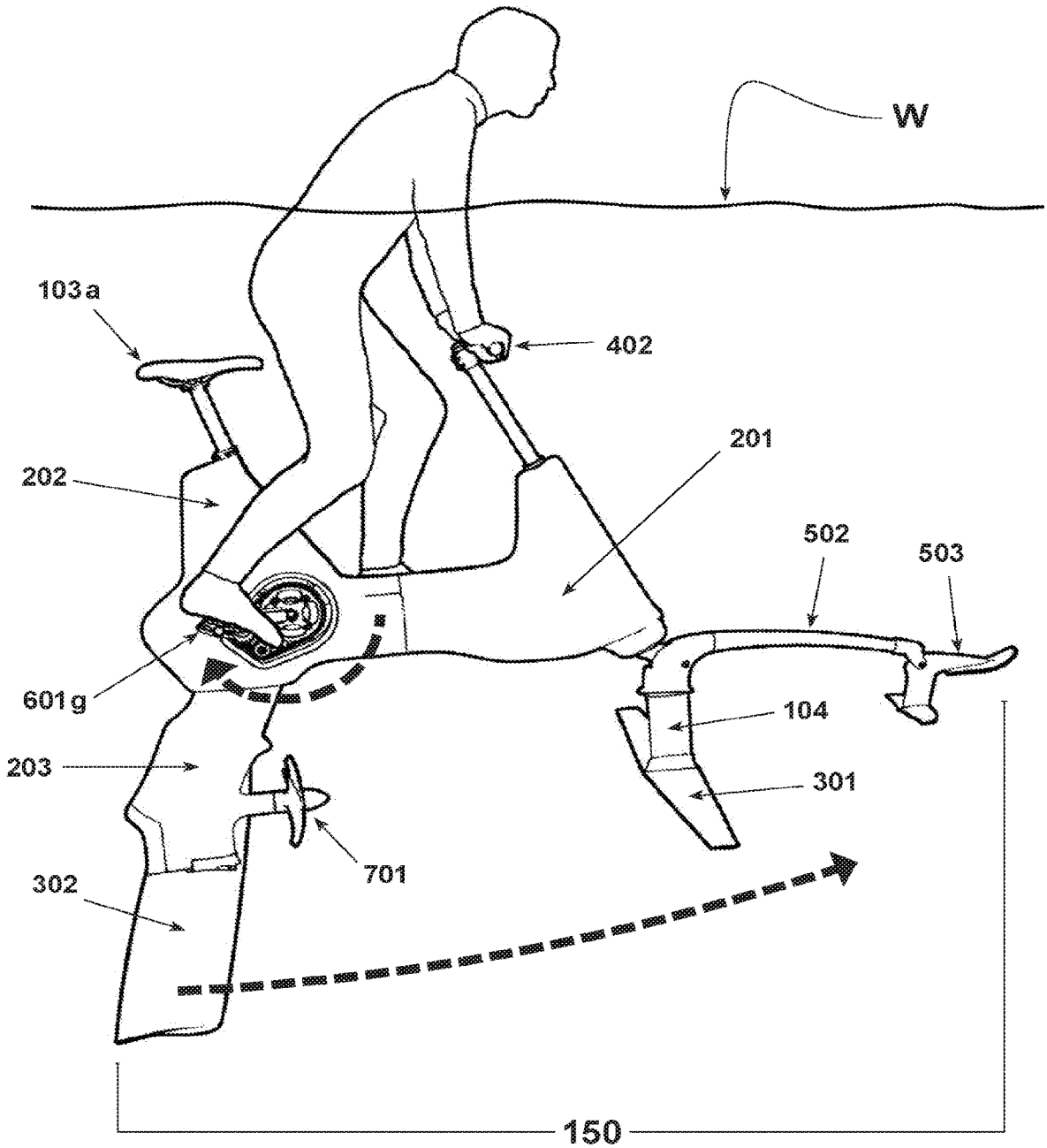
FIG. 9 is a perspective view depicting a favorable momentary position for the hydrofoil bike and rider, prior to starting a submerged launch maneuver.

FIGS. 2A and 2B illustrate how the buoyancy modules (201-202) and the rear strut cowling (203) are split into two halves (201L, 201R; 202L, 202R; and 203L, 203R respectively) along its vertical centerline in this exemplary embodiment. The central portions of the modules and cowling halves have matched cavities that allow them to encapsulate appropriate portions of the bike frame (100) and all drive assemblies, such that vital operational functions and user movements are unimpeded. The buoyancy modules (201, 202, 203) are preferably formed with void space between inner and outer surfaces, either open or filled with a lightweight filler (e.g. closed cell foam) so that the modules (201, 202, 203) are low density and add buoyancy to the bike (150). This buoyancy is preferably enough to give the bike overall slightly positive buoyancy. In this way, the bike (150) cannot sink and allows for deep water starts (as depicted in FIG. 9) without requiring a bulky and high drag hull.

Figure 2C:
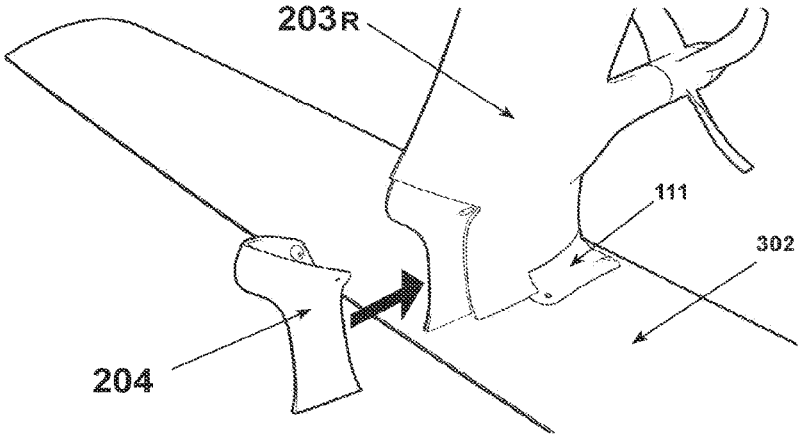
FIG. 2C is a series of two perspective views depicting an optional protective tail-piece at the rear portion of the streamlined strut cowling.
Figure 2C:
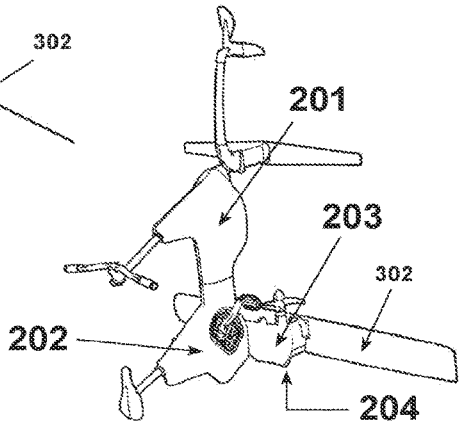

On occasions where the user may want to park the hydrofoil bike to rest on the ground from its rear end, an optional tail-piece (204) may be utilised to protect and reinforce the rear portion of the strut cowling (203) as shown in FIG. 2C (i) and (ii). The tail-piece (204) can be made of resilient material, such as nylon or polyethylene, so that the non load-bearing cowling (203) construction can remain as lightweight as possible. The tail-piece (204) is a replaceable item that also serves as a fastener to secure the rear of the cowling halves (203R and 203L) together.

The preferred hydrofoil canard arrangement in FIG. 3 depicts a rudimentary embodiment of a hydrofoil bike (150*a*) that utilizes a versatile multi-purpose rear foil (302) and front foil (301) designs—the size and span of which are complementary to each other. The rear foil (302) is designed to be capable of low-speed submerge launching (high lift), but also has very good high-speed cruising characteristics (relatively low drag within the intended cruising speed range). Both the rear foil (302) and the front foil (301) (or at least one of them) utilize a purposely developed supercritical style hydrofoil profile (300). Its cross-sectional detail is depicted in FIG. 3A. The leading end is (300*a*) and the trailing end (300*b*) has a butted square trailing edge. The distance between them is the chord length (300*c*).

The particular supercritical style hydrofoil profile depicted in FIG. 3A has a cross-sectional profile that is generally defined by an upper surface of convex form and a lower surface of recurve form, with a convex forward portion and a concave rearward portion. The upper surface and lower surface come together at a leading edge and also come together at the trailing end (300*b*). The upper surface has an upper maximum which is slightly closer to the leading edge than to the trailing end (300*b*). In particular, this upper maximum is preferably between 30% and 50% of the way from the leading edge to the trailing edge, and most preferably at between 40% and 45% of the way from the leading edge to the trailing edge.

The lower surface has a lower minimum which is located in the forward convex portion of the lower surface, and preferably about 30% of the way from the leading edge to the trailing edge, but generally between 20% and 40% of the way from the leading edge to the trailing edge. The lower surface has a recurve contour with an inflection point (where it transitions from being convex to being concave) which is preferably located between 40% and 70% of the way from the leading edge to the trailing edge, and most preferably at about 60% of the way from the leading edge to the trailing edge. The concave rearward portion of the lower surface has a local maximum which is preferably located between 70% and 90% of the way from the leading edge to the trailing edge, and most preferably located at about 82% of the way from the leading edge to the trailing edge.

The supercritical foil profile (300) preferably has a thickness which is about 15% of the chord length at its greatest extent (and generally between 10% and 20%), which is located generally between 20% and 50% of the way from the leading edge to the trailing edge. Other details of the hydrofoil profile (300) can be discerned from careful study of FIG. 3A.

Figure 3B:
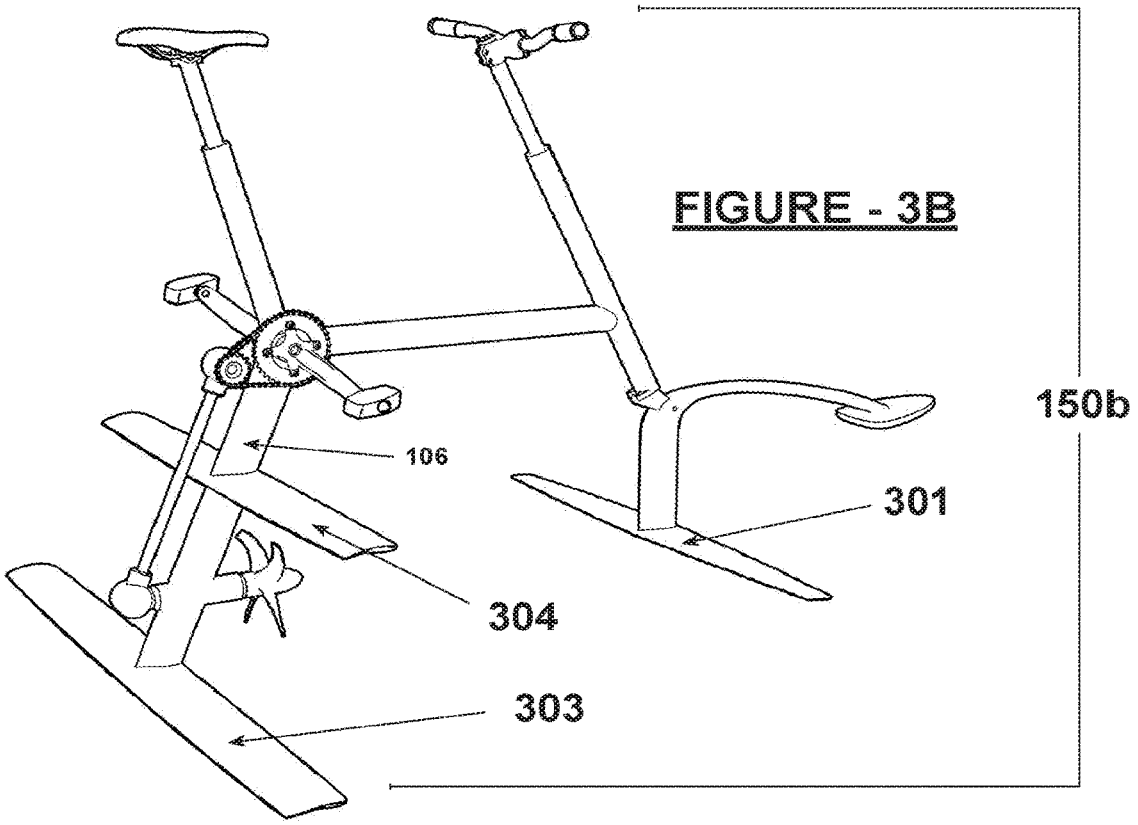
FIG. 3B is a perspective view depicting an exemplary embodiment of a hydrofoil bi-plane arrangement that utilizes a secondary or auxiliary foil.

At much higher top cruising speeds, a general purpose rear foil (302) will have excessive lift and drag characteristics. A rear foil with a shorter chord length and narrower wingspan is more suitable for high speed applications. A typical high speed foil (303) as seen in FIG. 3B is depicted in a rudimentary embodiment of a hydrofoil bike (150*b*). It has lower drag characteristics but it comes at the expense of reduced lift, such that low speed submerged launching may no longer be possible.

FIG. 3B also illustrates a bi-plane configuration whereby an auxiliary rear foil (304) is employed to augment the lift deficiency of a smaller high speed rear foil (303). Both foils (303 and 304) are submerged initially, so that their combined lift output is sufficient to elevate the vehicle from a submerged launch maneuver. However, as soon as the vehicle gathers sufficient speed, the auxiliary foil (304) affixed appropriately onto the rear strut (106), is eventually elevated above the surface of the water. In doing so, the extraneous lift and drag generated by an auxiliary foil (304) at high cruising speeds is eliminated. Other styles of auxiliary foils (304) may be appropriately attached to intermediary structural members extending from the rear strut (106), or the mid-section of the bike frame (101), or from the ends or any portion of the rear foil itself (302). Such an auxiliary foil (304) can also act to guard the propeller (700) (FIG. 6) from contacting a user's foot, should it slip off of the pedals (601).

Figure 3C:
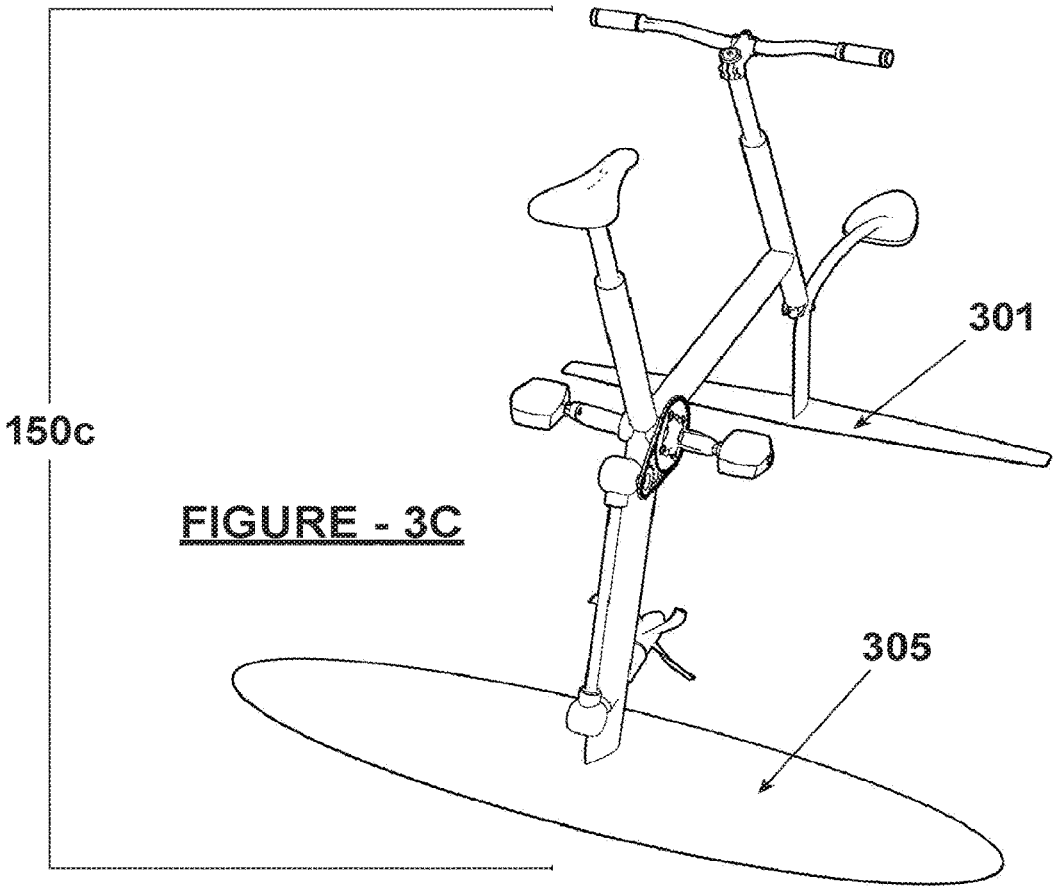
FIG. 3C is a perspective view depicting an exemplary embodiment of a hydrofoil arrangement that utilizes an elliptical-style rear foil.
Figure 3D:
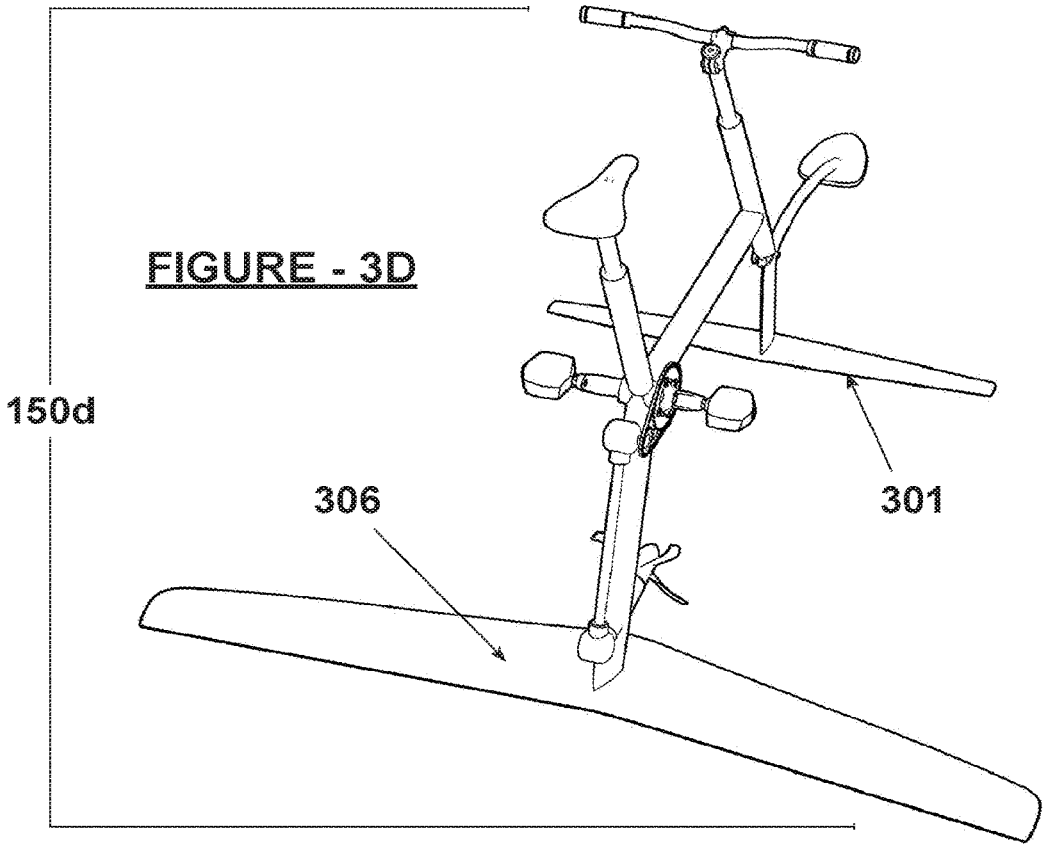
FIG. 3D is a perspective view depicting an exemplary embodiment of a hydrofoil arrangement that utilizes a swept-back rear foil.
Figure 3E:
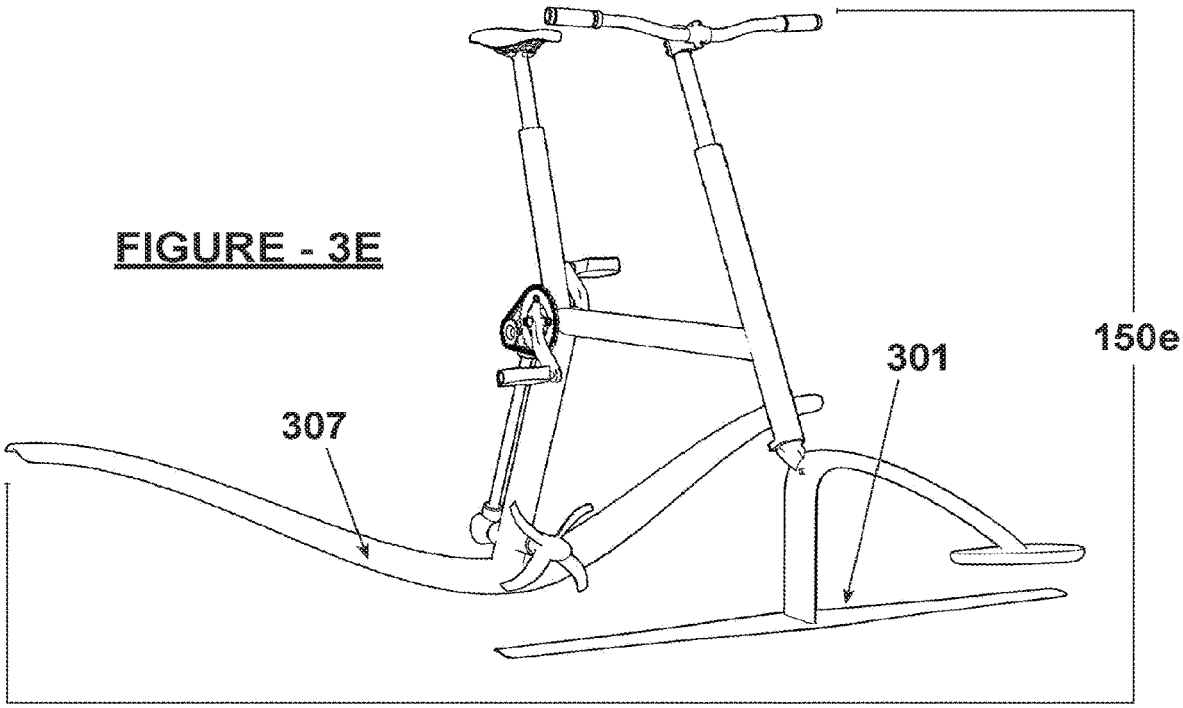
FIG. 3E is a perspective view depicting an exemplary embodiment of a hydrofoil arrangement that utilizes a surface-piercing rear foil.

FIG. 3C depicts a rudimentary embodiment of a hydrofoil bike (150*c*) which has an elliptical rear foil (305) being employed to achieve enhanced or specialized maneuvering characteristics, where a narrower wingspan combined with a much longer chord length (300*c*) at the midsection of the rear foil (305) is desirable. FIGS. 3D and 3E depicts rudimentary embodiments of a hydrofoil bike (150*d* and 150*e*) equipped with representations of a swept-back wing (306) and a surface-piercing hydrofoil (307), respectively. Both foil types are solutions to manage extraneous lift and drag characteristics at higher cruising speeds.

Although FIGS. 3B, 3C, 3D and 3E illustrate various foil types as alternatives to a preferred multi-purpose rear foil (302) as applied to the rear section of the bike (100R), it is not beyond the scope of the invention to employ any of these foil types as alternatives to a preferred front foil (301) as applied the front section of the bike (100F). The front and rear foils may be a matched pair of any one particular foil type alternative, or may be configured in any mismatched combination.

Figure 4:
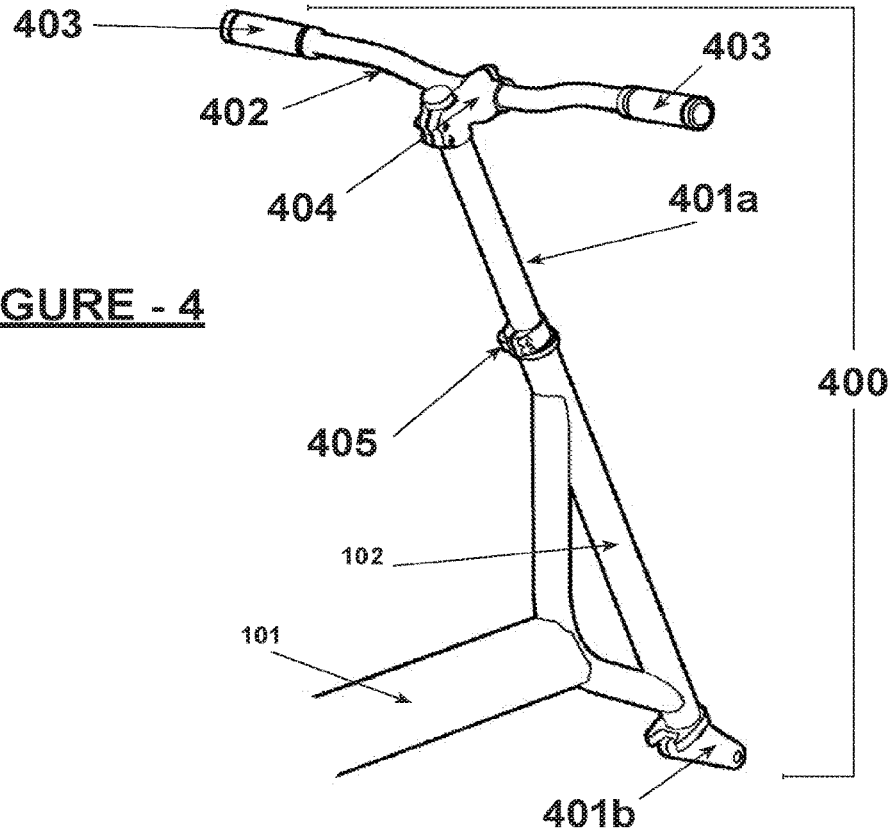
FIGS. 4 & 4A are perspective views of an exemplary embodiment of a steering assembly.
Figure 4A:
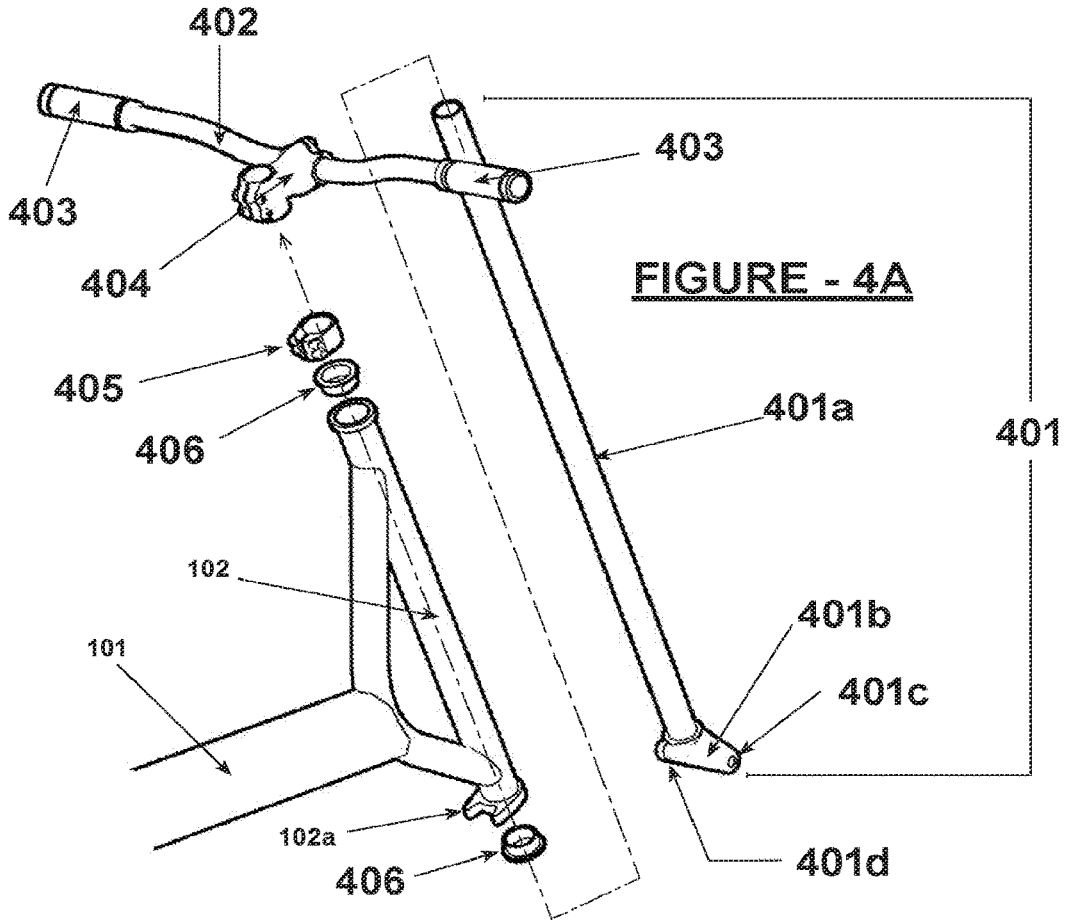

A preferred embodiment of the steering mechanism (400) of the vehicle is associated with the front section (100F) of the bike frame (100), and is illustrated in FIGS. 4 and 4A.

A steering fork (401) is inserted from the bottom end of the head tube (102). Its steerer tube (401*a*) can rotate along its axis, supported by low-friction bearings or bushings (406) at the top and bottom end of the head tube (102). The steering fork is held securely in place by a locking clamp (405) affixed adjacent to the top steerer bushing (406).

A handlebar (402) with hand grips on either end (403) is attached to an intermediary stem (404) which is then attached to the top end of the steerer tube (401*a*). A fork horn (401*b*) extends forward from the base of the steerer tube (401*a*). The forward end of the fork horn (401*b*) has a transverse fork horn or pivotal aperture (401*c*) onto which a pivot junction (501) is attached (sec FIG. 5). The rear end of the fork horn (401*b*) has a structural protrusion (401*d*) that fits into a restrictor slot (102*a*) at the base of the head tube (102). The restrictor slot (102*a*) limits the movement of the fork protrusion (401*d*), and so therefore restricts the rotational movement of the fork horn (401*b*) along its steerer tube (401*a*) axis according to this exemplary embodiment. This restricted fork movement is in direct proportion to the side to side pivotal movement of the front strut (104), see in FIG. 1A, relative to its function as a rudder.

Figure 5:
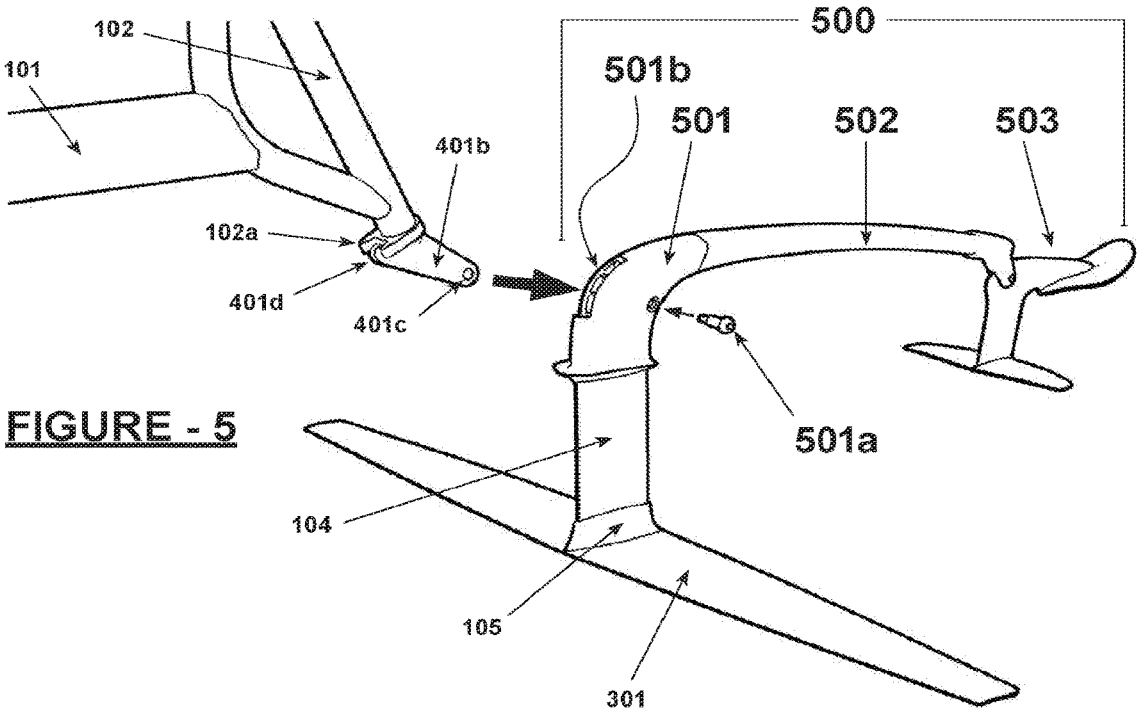
FIG. 5 is a perspective view of an exemplary embodiment of a preferred tiller assembly.
Figure 5A:
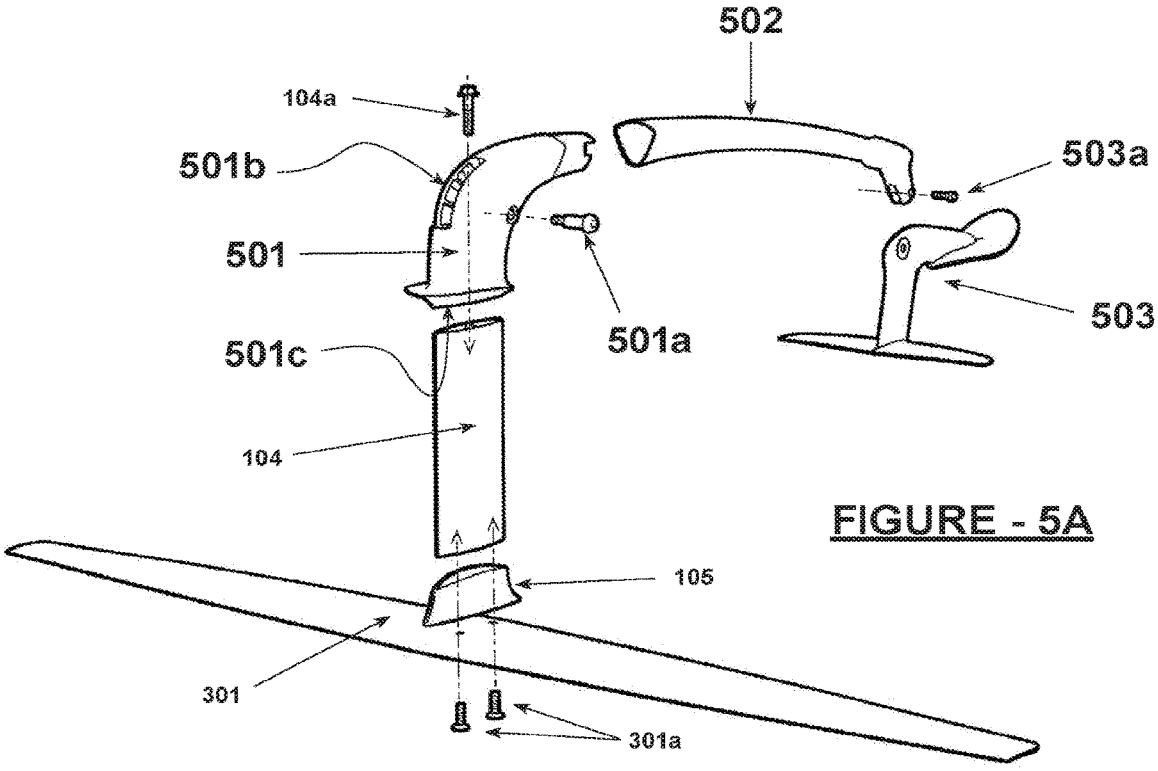
FIG. 5A is an exploded perspective view of FIG. 5.
Figure 5B:
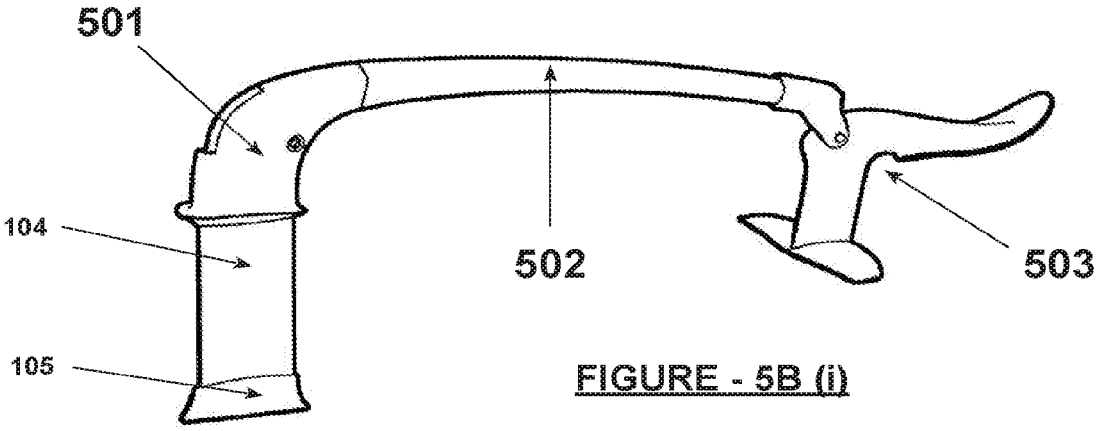
FIG. 5B are a series of typical perspective views of different tiller arms and tiller heads.
Figure 5B:
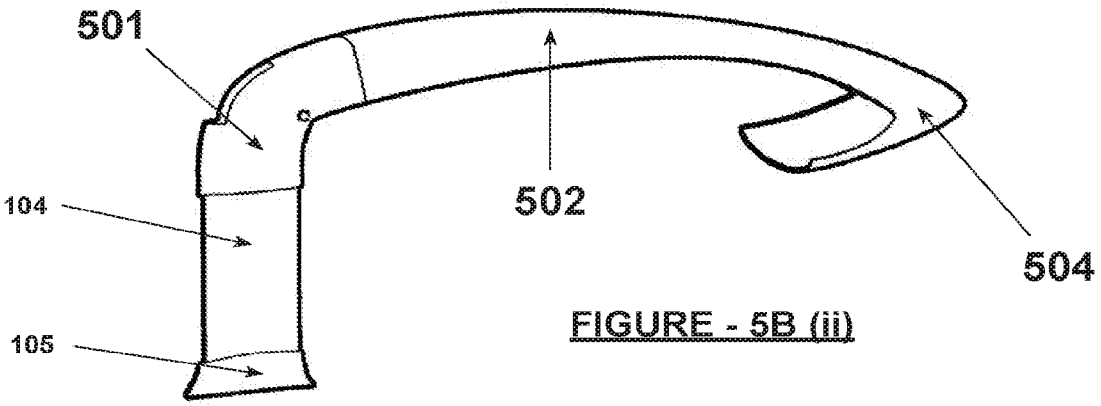
Figure 5B:
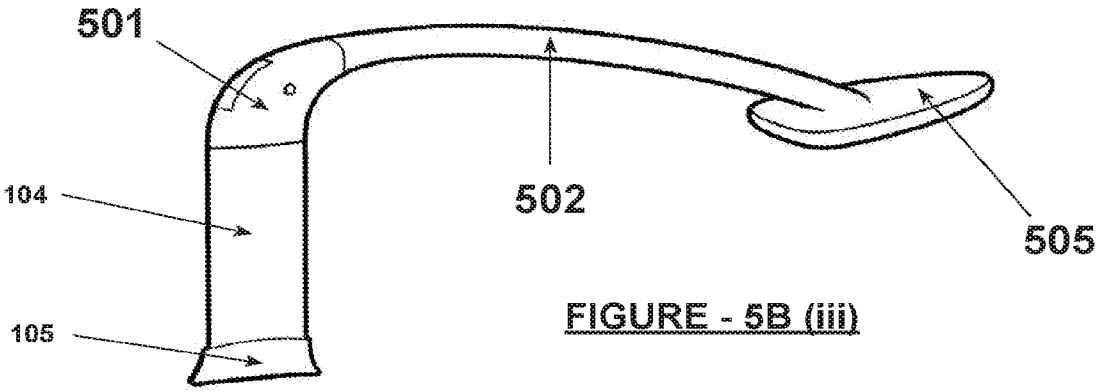

As shown in FIGS. 5 to 5B(iii) a tiller module (500) is provided as a pivoting mechanism that enables an automatic, self-correcting pitch control for the front foil (301). The mechanism is comprised of a pivot junction (501), a tiller arm (502), and a tiller head (503 preferred). The pivot junction (501) is attached to the fork horn aperture (401*c*) via a transverse pivot pin (501*a*). The pivot junction (501) has a top cavity (501*b*) and a bottom cavity (501*c*). The fork horn (401*b*) is inserted into the top cavity (501*b*) which forms a mechanical restrictor that limits the transverse pivotal up/down movement of the tiller module (500). This restricted tiller movement is in direct proportion to the transverse pivotal forward/aft pendulum movement of the front strut (104), because the strut is integrated into the bottom cavity (501*c*) of the pivot junction (501).

The integration is secured by an appropriate fastener (104*a*) which is inserted from the top of the pivot junction (501) and tightened against a threaded portion at the top end of the front strut (104). Because the front foil (301) is directly connected to the bottom end of the front strut (104), the strut's transverse pivotal forward/aft pendulum movement changes the pitch (angle of attack) of the front foil (301) accordingly.

The front end of the tiller arm (502) can be fitted with various tiller heads depicted in FIG. 5B(i) to (iii). The tiller head may be a simple skid-plate (505), or a streamlined bulb or nose cone (504), or another miniature pivoting tiller mechanism (503) to constitute a compounded tiller module (500), which is a preferred embodiment.

Figure 6:
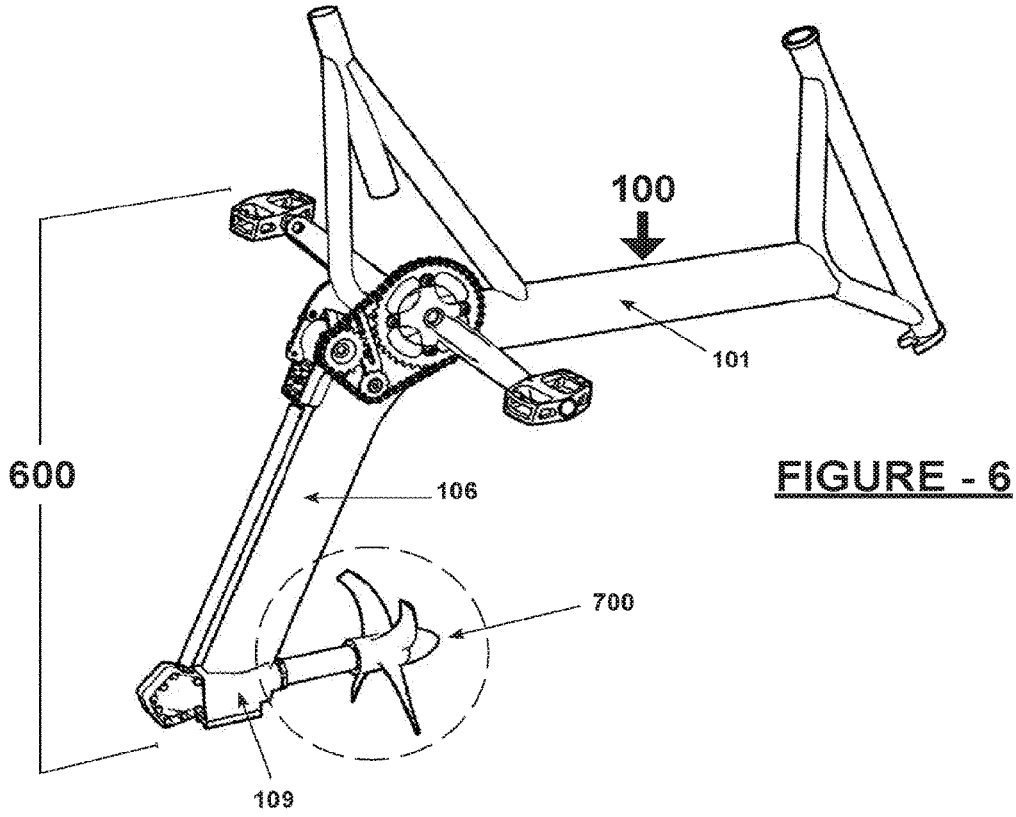
FIG. 6 is a perspective view of an exemplary embodiment of a preferred drivetrain assembly.
Figure 6A:
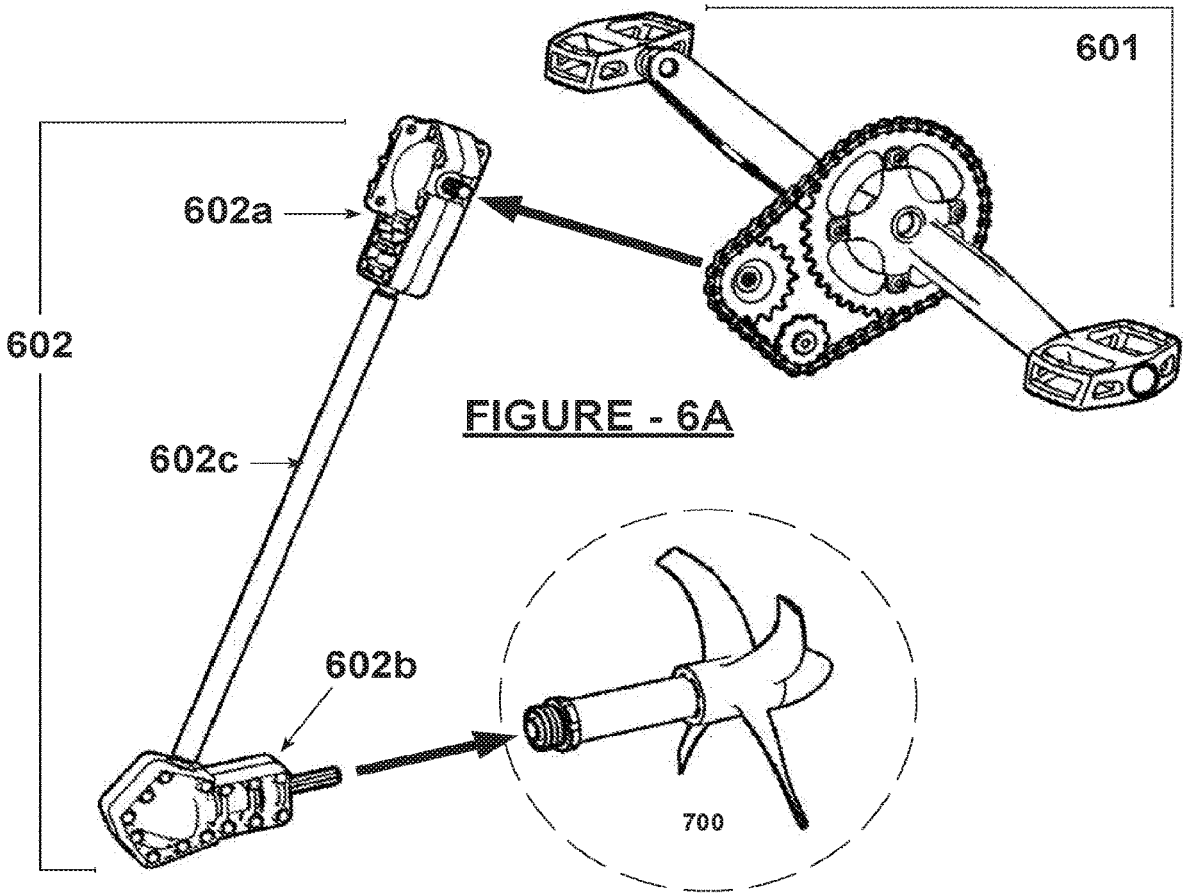
FIG. 6A is an exploded perspective view of an exemplary embodiment of a preferred drivetrain assembly, depicting its two main sub-sections; the drive-mechanism and the gearbox units, relative to the placement of the propeller assembly.

FIG. 6 is a perspective view of an exemplary embodiment of a preferred drivetrain assembly (600) that delivers power from a power source to the propeller (701) or other prime mover, and a propeller assembly (700) relative to the bike frame (100). The drivetrain assembly (600) has two sub-sections; the drive mechanism sub-section (601), and the gearbox units sub-section (602) as depicted in FIG. 6A. The gearbox sub-section (602) is comprised of an upper gearbox (602*a*), a lower gearbox (602*b*), and a vertical driveshaft (602*c*) which connects them both.

Figure 6B:
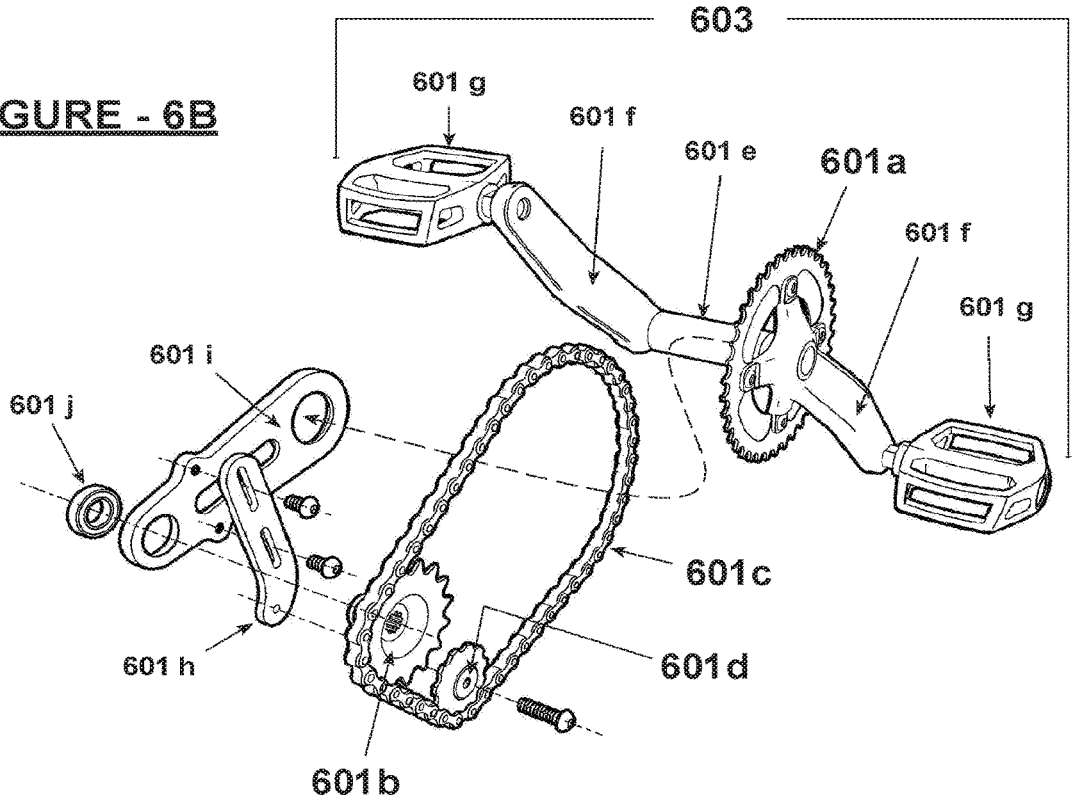
FIG. 6B is an exploded perspective view of an embodiment of a drive-mechanism sub-section.
Figure 6C:
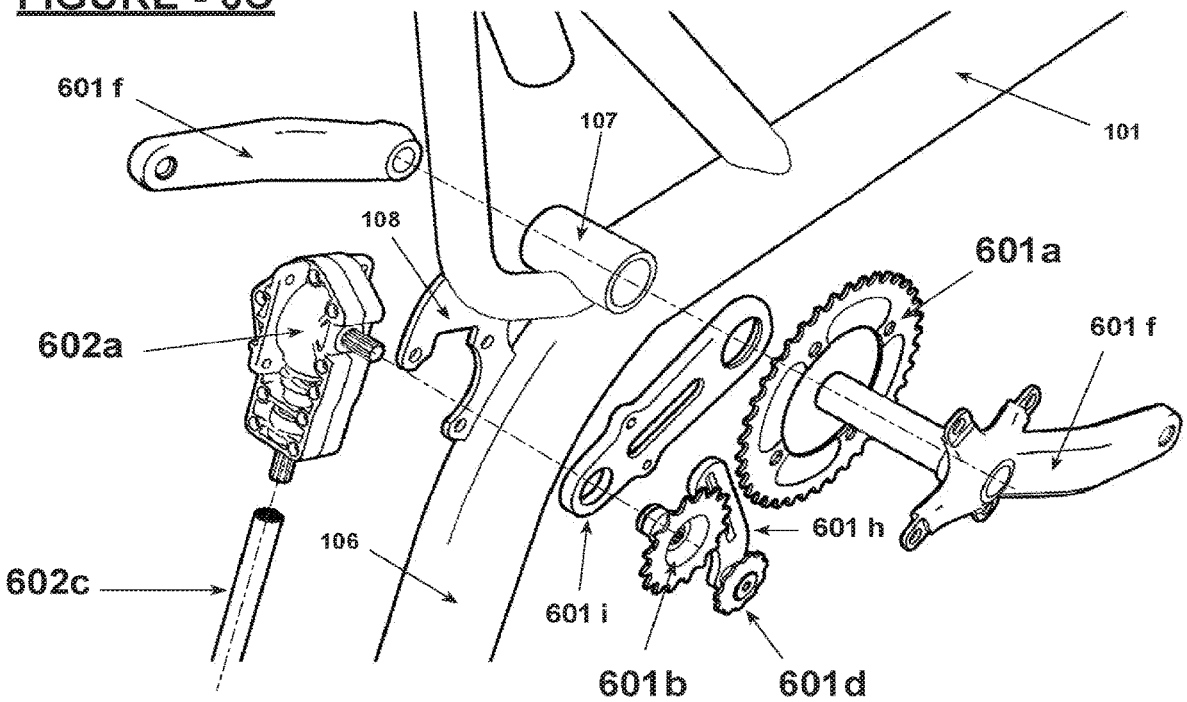
FIG. 6C is an exploded perspective view of an embodiment of a drive-mechanism sub-section, relative to the bike frame and the top gearbox unit.

FIGS. 6B and 6C are exploded perspective views showing the various components of the exemplary drive mechanism sub-section (601). A crankset sub-assembly (603) may be installed relative to the bottom bracket tube (107) onto the bike frame (100). The crankset assembly (603) may be similar to a typical bicycle crankset sub-assembly. The drive sprocket-wheel (601*a*) also referred to as a chainring, transmits rotary motion to the drive sprocket wheel (601*b*) via a roller chain (601*c*), which is kept at a correct tension by an idler wheel (601*d*) held in place by a tensioner arm (601*h*) which is adjustably fastened to a torque plate (601*i*). The drive sprocket wheel (601*b*) is securely held and rotates along the axis of a ball bearing (601*j*) which is pressed into place at the back end of the torque plate (601*i*). The ball bearing (601*j*) supported by the torque plate (601*i*), bears the majority of the applied torque load being exerted onto the driven sprocket-wheel (601*b*). This configuration ushers two advantages; the upper gearbox (602*a*) having bevel gear axles with small internal bearings is therefore insulated from excessive side-thrust loads; and the upper gearbox (602*a*) may therefore be removed from the gusset plate (108) mount and replaced without having to dismantle the entire drive mechanism sub-section (601).

The chainring (601*a*) rotates along the axis of the crank axle (601*e*), which derives its rotational orientation from the bottom bracket tube (107) into which the axle (601*e*) and the bottom bracket bearings (not shown) are installed. The user applies human energy onto the pedals (601*g*) (as one form of power source) so that up and down leg motion is converted into rotary motion by the crank arms (601*f*), which drives the axle (601*e*), which in turn drives the chainring (601*a*).

Figure 6D:
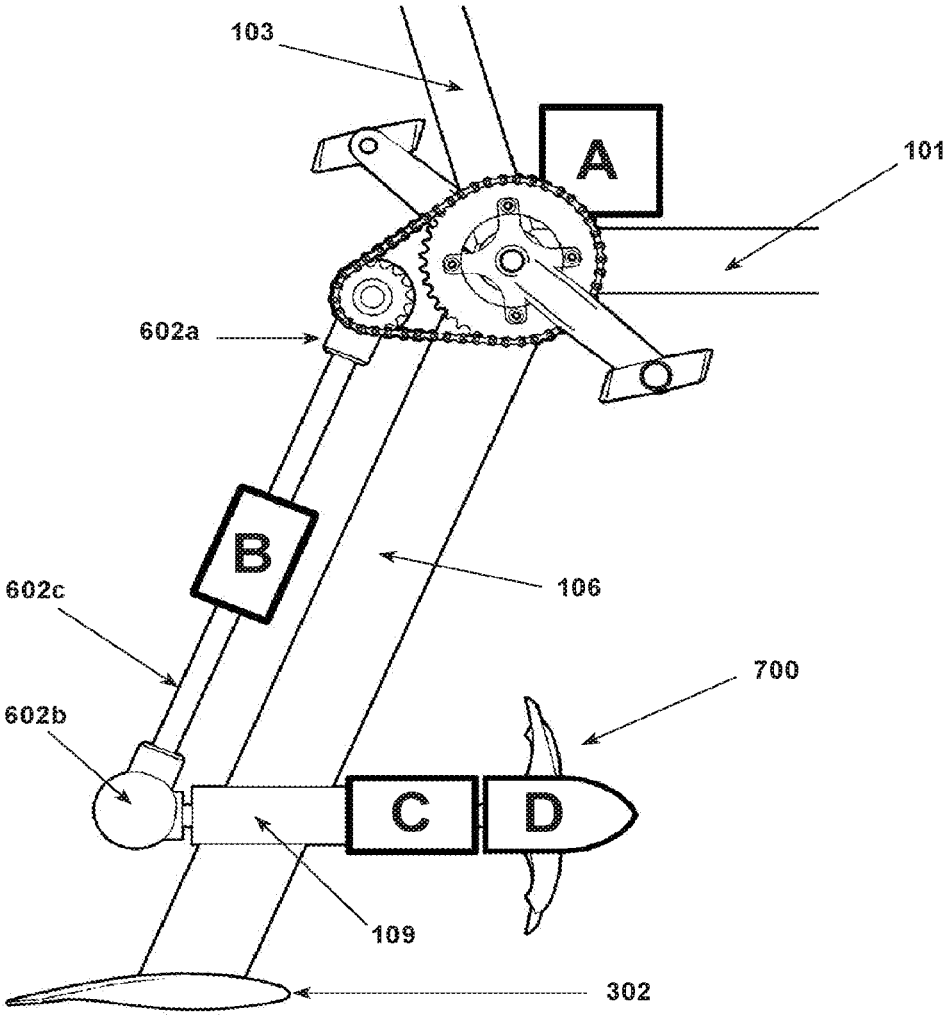
FIG. 6D is a diagram of typical locations where a singular motor or series of motors can be introduced along the drive-path of the drivetrain assembly.

Motorized configurations (fully-powered or pedal-assist modes) can be installed to transmit full or supplementary drive power along any sector of the drivetrain assembly (600) and propeller assembly (700), as depicted in a typical diagram FIG. 6D. A motor in position [A] may be internally integrated with gears to drive the crank axle (601*e*) directly, or may be externally integrated to drive the crank axle (601*e*) via an auxiliary set of sprocket-wheels with its own auxiliary roller chain.

Figure 6E:
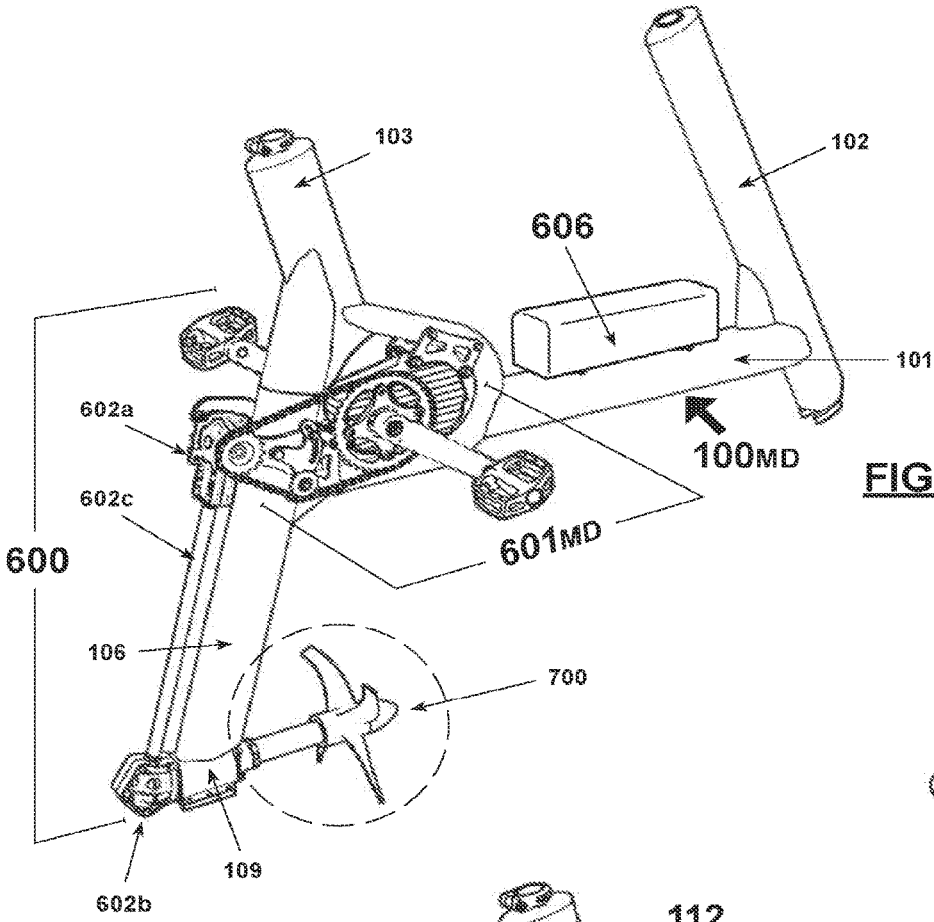
FIG. 6E is a perspective view of an exemplary embodiment of an alternative drivetrain assembly that incorporates a mid-drive electric motor.
Figure 6F:
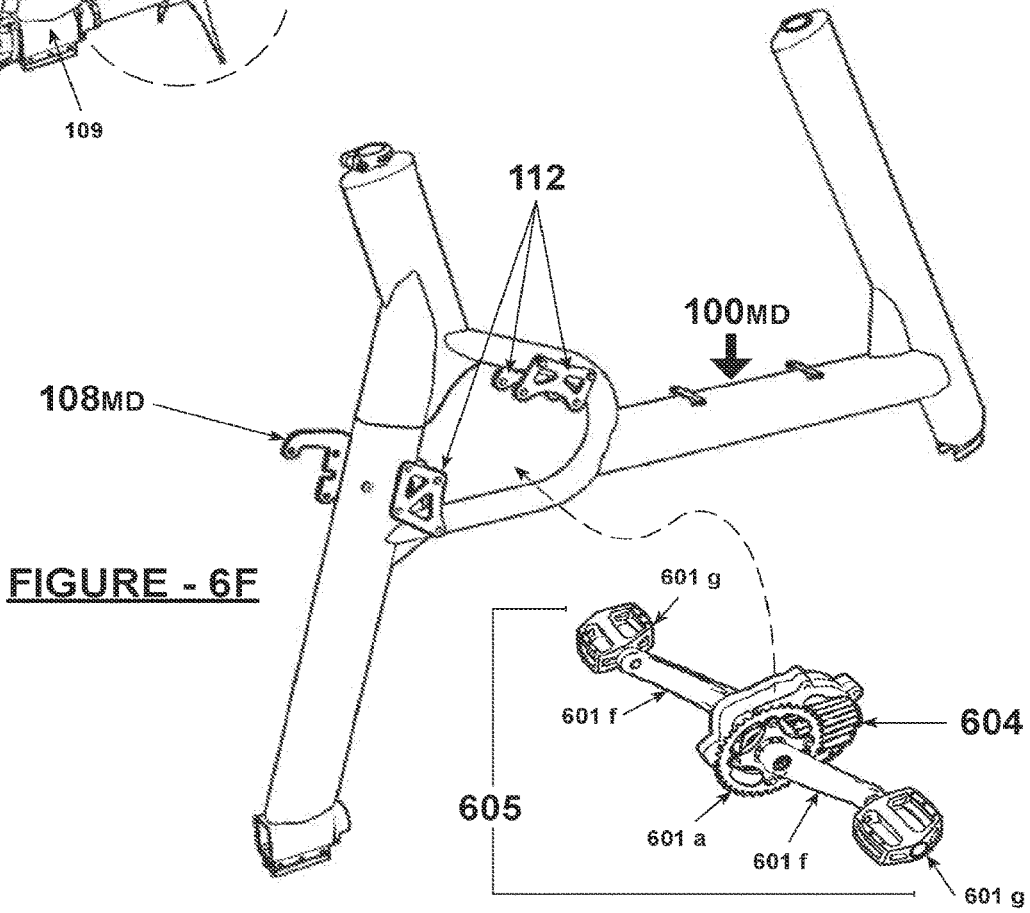
FIG. 6F is a perspective view of a bare frame specifically designed to accept a drivetrain assembly that incorporates a mid-drive electric motor, typically identified by the absence of a bottom bracket tube.

FIG. 6E is a perspective view of another exemplary embodiment of a preferred drivetrain assembly (600) that delivers power from a mid-drive motor assembly (601MD) in position [A] (see FIG. 6D) to the propeller (701) or other prime mover, and a propeller assembly (700) relative to a mid-drive bike frame (100MD). The mid-drive bike frame (100MD) is configured to accept a mid-drive motor (604) and a battery unit (606). Motorized mid-drive units (604) may typically incorporate a built-in crank axle (601*e*) or crankset assembly (603) as shown in FIG. 6F as mid-drive crank assembly 605. In this arrangement the mid-drive bike frame (100MD) is characterized by the absence of a bottom bracket tube (107), as depicted in FIG. 6F. A mid-drive motor (604) may be affixed to a mid-drive bike frame (100MD) using one or more gusset mounts (112), preferably there are a plurality of gusset mounts. Preferably the one or more gusset mounts are removable. One or more of the gusset mounts may function as a gusset mount (108MD) for the upper gearbox (602*a*). Other variations of mid-drive motor units (604) may be adapted easily to fit the mid-drive bike frame (100MD), by utilizing corresponding gusset mounts (112) that match the bolting pattern of said mid-drive motor unit variation. In some forms the motorized mid-drive unit (604) is electric and may include a self-contained and detachable battery unit (606) to provide the electrical power. A skilled addressee would appreciate that any type of battery may be used including rechargeable or non-rechargeable batteries. FIG. 6E depicts the battery (606) located but not limited to a position directly above the horizontal member (101). In other forms, other types of fuel or energy may be similarly contained and located to be used to power the motor—such as but not limited to petrol, diesel, combustible gaseous fuels or compressed gaseous propellants.

Figure 6G:
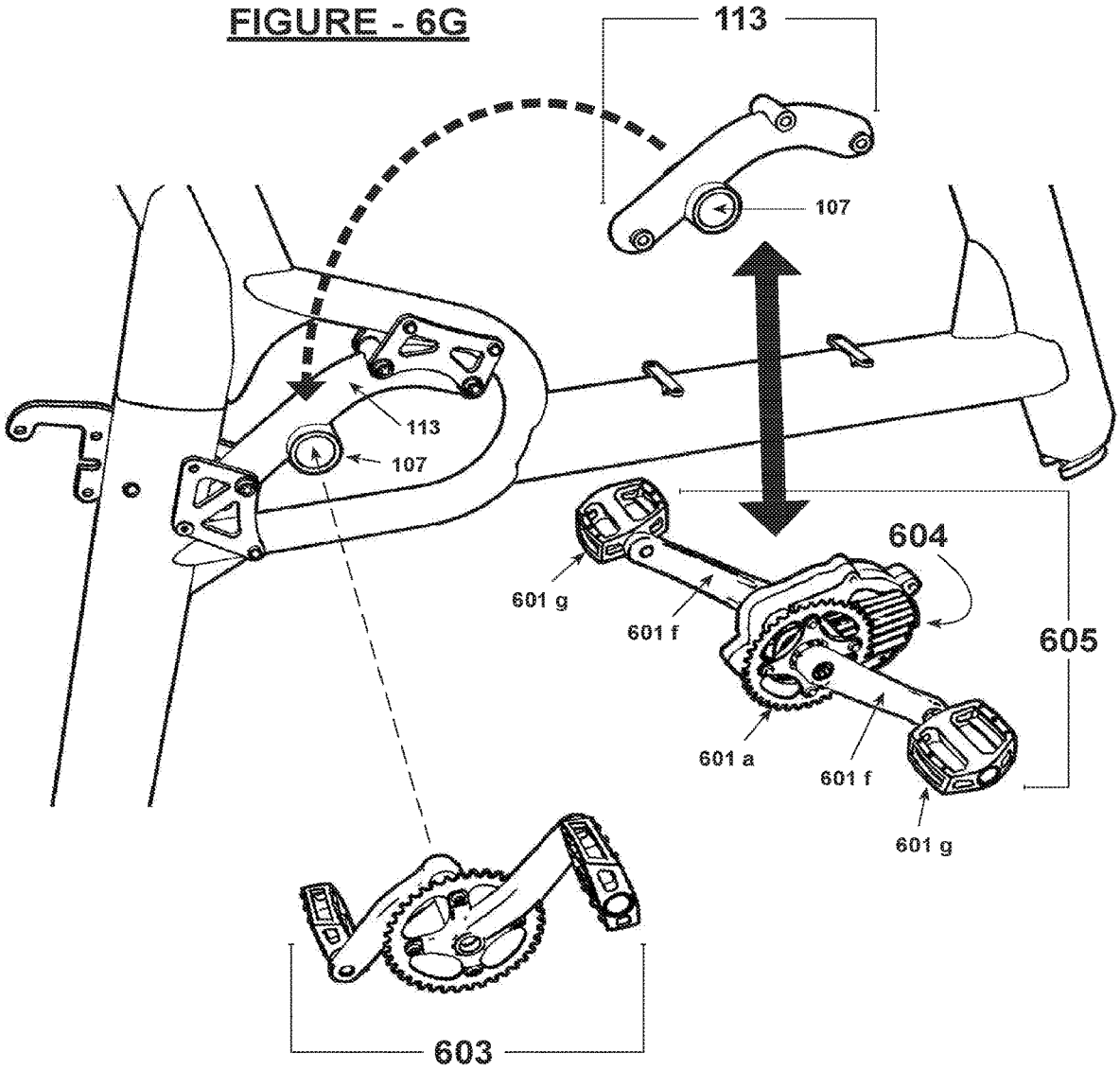
FIG. 6G is a perspective view of a bare frame specifically designed to accept a drivetrain assembly that incorporates a mid-drive electric motor, depicting a bottom bracket module so that the frame can reverted back to a manual non-motorized configuration.

FIG. 6G is a perspective view of an exemplary embodiment of a mid-drive bike frame (100MD) depicting a conversion method to revert the frame configuration back to utilize a manual non-motorized drive train (601). The conversion is achieved by replacing the mid-drive motor (604) with a bottom bracket module (113). The bottom bracket module (113) comprises a bottom bracket tube (107) to allow coupling of a typical crankset assembly. The bottom bracket module (113) is affixed to the mid-drive bike frame (100MD) via the one or more motor gusset mounts (112). After attachment of the bottom bracket module (113) a crankset assembly (603) may be installed to the bottom bracket tube (107) of the bottom bracket module (113).

A motor in position [B] may be integrated to drive the vertical driveshaft (602*c*) directly. A motor in position [C] which may be placed in front, within, or behind the thrust tube (109) integrated to drive the propeller shaft (707) (as seen in FIG. 7A) directly. A motor in position [D] may be integrated inside the cylindrical boss of the propeller (701*a*) itself (as seen in FIG. 7C).

Although a single motor may be placed in one location [either A, B, C, or D], it is not beyond the scope of the invention to employ more than one motor in any two or more locations within the drivetrain assembly (600) and propeller assembly (700). Further to this, a completely independent motor (or motors) that is mechanically separated from a pedal-operated drivetrain, may be integrated on one location or multiple locations on the bike to provide full or supplementary sources of propulsion.

Figure 7:
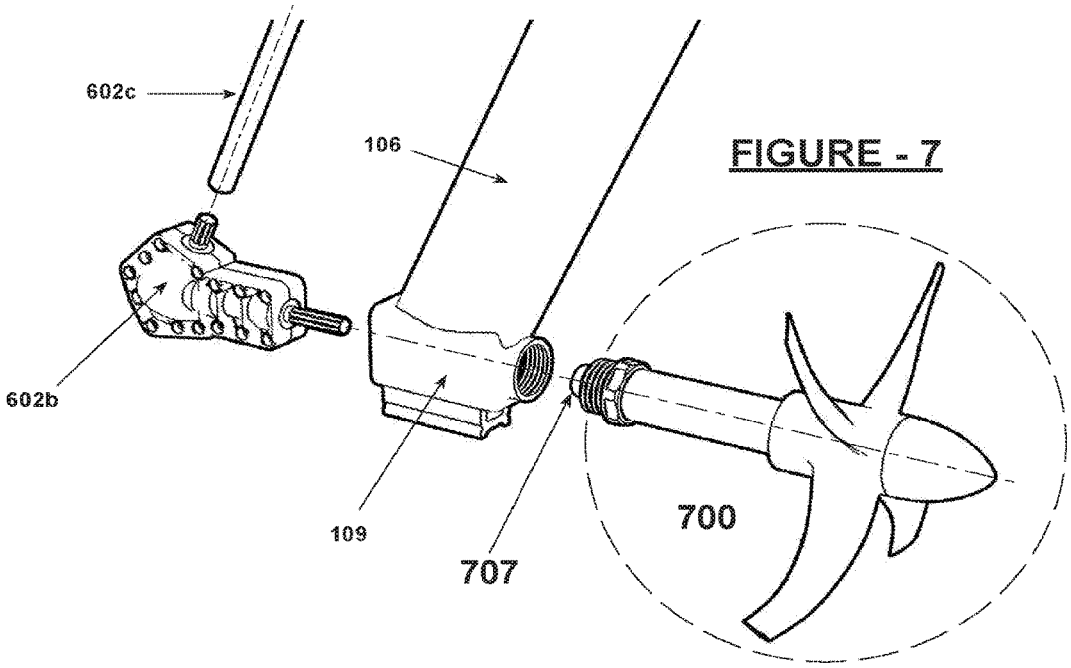
FIG. 7 is a perspective view of an exemplary embodiment of a preferred propeller assembly, relative to the thrust-tube of the frame and the lower gearbox.
Figure 7A:
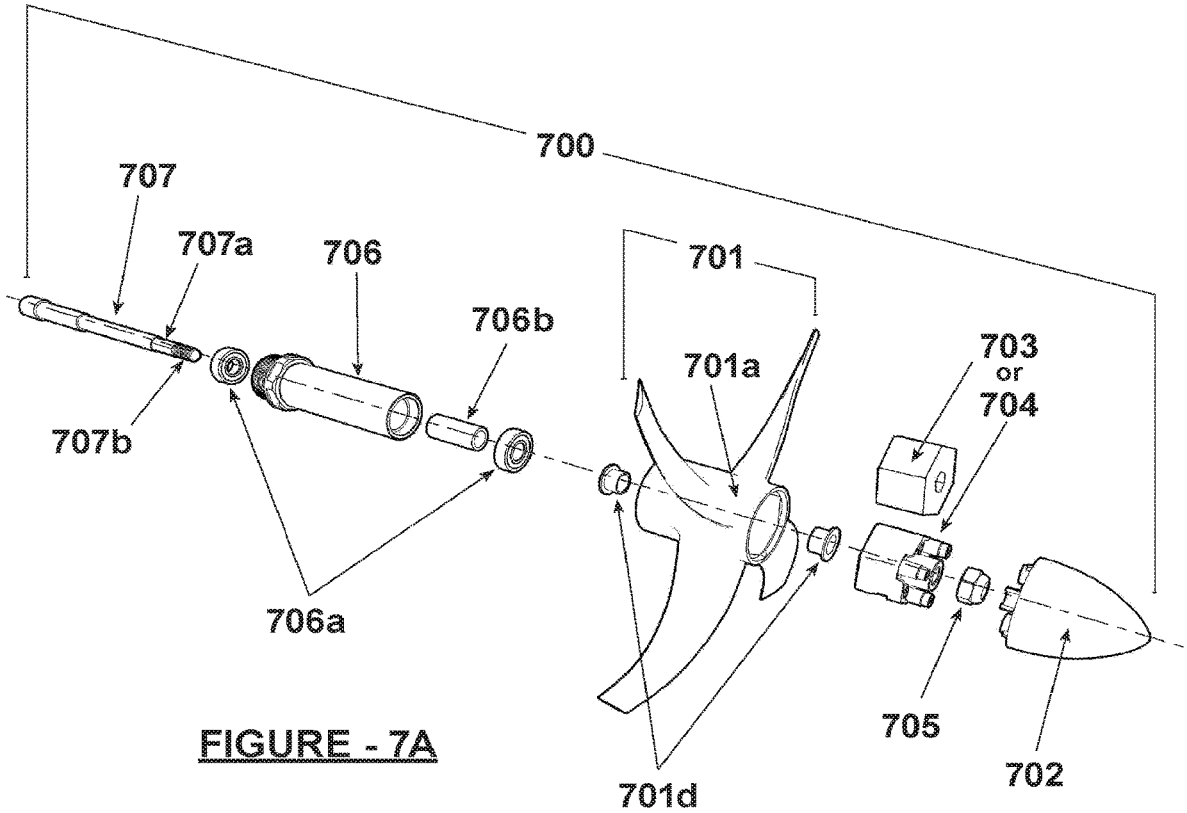
FIG. 7A is an exploded perspective view of an exemplary embodiment of a preferred propeller assembly.

FIG. 7 shows that the propeller assembly (700) is located ahead of the rear strut (106) and is directly attached to the front end of the thrust tube (109). When rotational energy is applied to the propeller assembly (700), it produces thrust such that it pulls the thrust tube (109) and all associated structural members along with it, and therefore propels the whole vehicle forward. Generally, the rotation axis of the propeller assembly (700), the longitudinal centerline of the thrust tube (109) and the rotational axis of the forward-facing output shaft of the lower gearbox unit (602*b*), share a precise commonality.

As seen in FIG. 7A, propeller shaft (707) with a female spline interface protrudes at the rear end of the propeller assembly (700). The lower gearbox unit (602*b*) is attached to the rear end of the thrust tube (109). Its forward-facing output axle has a male spline interface which couples directly with the rear end of the propeller shaft (707) inside the thrust tube (109). This splined coupling is free to move forward and aft even while drive force is applied, but is axially fixed by the structural association provided by the thrust tube (109). Therefore only the thrust tube (109) and the rear strut (106) connected to it, are subjected to the full thrust load generated by the propeller assembly (700), thus pulling the bike forward. This configuration ushers two advantages; the lower gearbox (602*b*) having axles with small internal bearings is therefore insulated from excessive frontal-thrust loads; and the lower gearbox (602*b*) as well as the propeller assembly (700) can therefore be removed from the bike frame and replaced without prior dismantling of either assembly.

FIG. 7A is an exploded perspective view showing the various parts that comprise the propeller assembly (700) in detail. Thrust bearings (706*a*) are pressed into stepped apertures at the front and rear of the bearing hub (706), with a spacer tube (706*b*) in between them. The propeller shaft (707) is inserted from behind the bearing hub (706) and passes through the centre of the bearings (706*a*) and spacer (706*b*), such that the propeller shaft (707) is allowed to freely rotate along the central axis of the bearing hub (706) but cannot be pulled forward and removed out the front of its hub (706). Low-friction bushings (701*d*) are pressed into stepped apertures at the front and rear of the cylindrical propeller boss (701*a*) (as seen in FIG. 7C), such that the propeller (701) freely rotates along the axis of the propeller shaft (707) regardless of whether the shaft is stationary or rotating with drive motion. Without an intermediary hexagonal drive block (703 or 704) installed inside the hexagonal cavity (701*c*) located at the front of the cylindrical propeller boss (701*a*), the propeller shaft (707) is incapable of driving the otherwise free-spinning propeller (701).

The drive block (703 or 704) has a hexagonal hole running through the entire length of its central axis. The front end of the propeller shaft (707) has a matching hexagonal spline (707*a*) which is inserted through the centre of the drive block (703 or 704) which forms an interface whereby the propeller shaft (707) is able to rotate the drive block (703 or 704), which in turn is able to rotate the propeller (701).

A ratchet-type drive block (704) is capable of rotating the propeller (701) only in its thrust direction, but will spin-freely in the opposite direction. Whereas a solid-type drive block (703) is capable of rotating the propeller (701) in either direction, so that it may be used to produce propulsion and a braking effect. A locknut (705) is installed on the threaded portion (707*b*) of the propeller shaft (707) which then unifies all the various parts of the assembly (700)—with the exception of the propeller nose cone (702) which is a non load-bearing member. An appropriately designed nose cone (702) is held in place either by the threaded portion (707*b*) protruding past the locknut (705) (as in the case when a solid drive block (703) is used), or the nose cone may be press-fitted into protrusions at the front of a ratchet drive block (704).

Figure 7B:
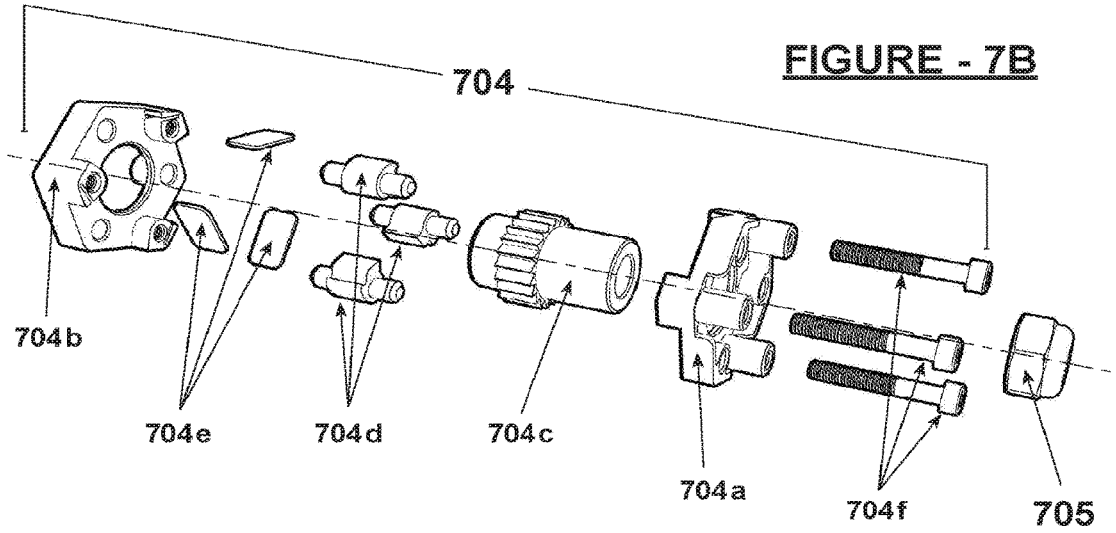
FIG. 7B is an exploded perspective view of an exemplary embodiment of a preferred configuration of a ratchet-type propeller drive-block.
Figure 7C:
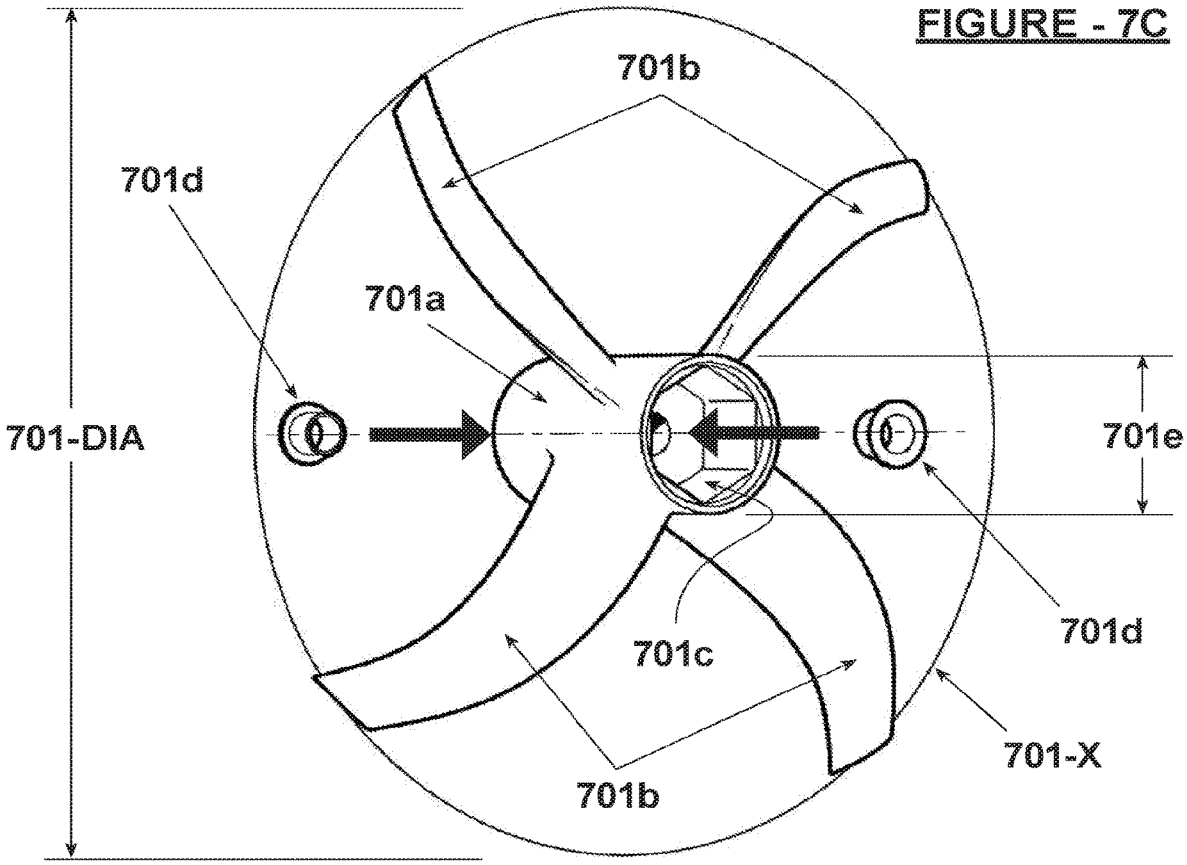
FIG. 7C is an exploded perspective view of an exemplary embodiment of a preferred propeller.

FIG. 7B is an exploded perspective view showing the various parts that comprise the preferred embodiment of a ratchet-type drive block (704). A central thimble barrel (704*c*) has a central hexagonal hole running through its entire length, which is coupled to the matching hexagonal spline (707*a*) of the propeller shaft (707) resulting in a secure connection capable of bearing the entire thrust load of the propeller (701), as seen in FIG. 7A. The central thimble barrel (704*c*) has ratchet teeth all along its outer periphery which engage with pawls (704*d*) that are pivotally encapsulated within a hexagonal housing (704*a* and 704*b* combined) that fits inside the propeller cavity (701*c*). Dedicated flat reed springs (704*e*) fit between dedicated slits in posts extending rearward from the front half (704*a*) and forward from the rear half (704*b*) of the hexagonal housing and also press against cam grooves in the pawls (704*d*). These springs (704*e*) ensure that each of the pawls (704*d*) engage or disengage against the ratchet teeth, depending on direction of rotation of the propeller. Fasteners (704*f*) in the form of long bolts which thread into threaded bores in the posts of the rearward half (704*b*), pass through holes in the forward half (704*a*) of the hexagonal housing to unify the entire ratchet assembly. These bolts (704*f*) or other fasteners also serve as structural protrusions to press-fit the nose cone (702) into.

A propeller (701) may have any number of blades (701*b*), typically ranging from 2 to 6 (4 blades illustrated) arising from a central cylindrical boss (701*a*) with a diameter (701*e*) ranging from approximately 2 to 4 inches (approximately 50 mm to 100 mm), as shown in FIG. 7C. The circular travel path of the blade ends (701-X) defines the diameter (or size) of the propeller (701-DIA) with a range between approximately 8 to 14 inches (approximately 203 to 355 mm). The depth (701-Y) between the surface of the water [W] and the upper extremity of the circular travel path of the blade ends (701-X) ranges from a minimum of 60 mm and a maximum of 300 mm depending on the operational application, is depicted in FIG. 7D.

Figure 7D:
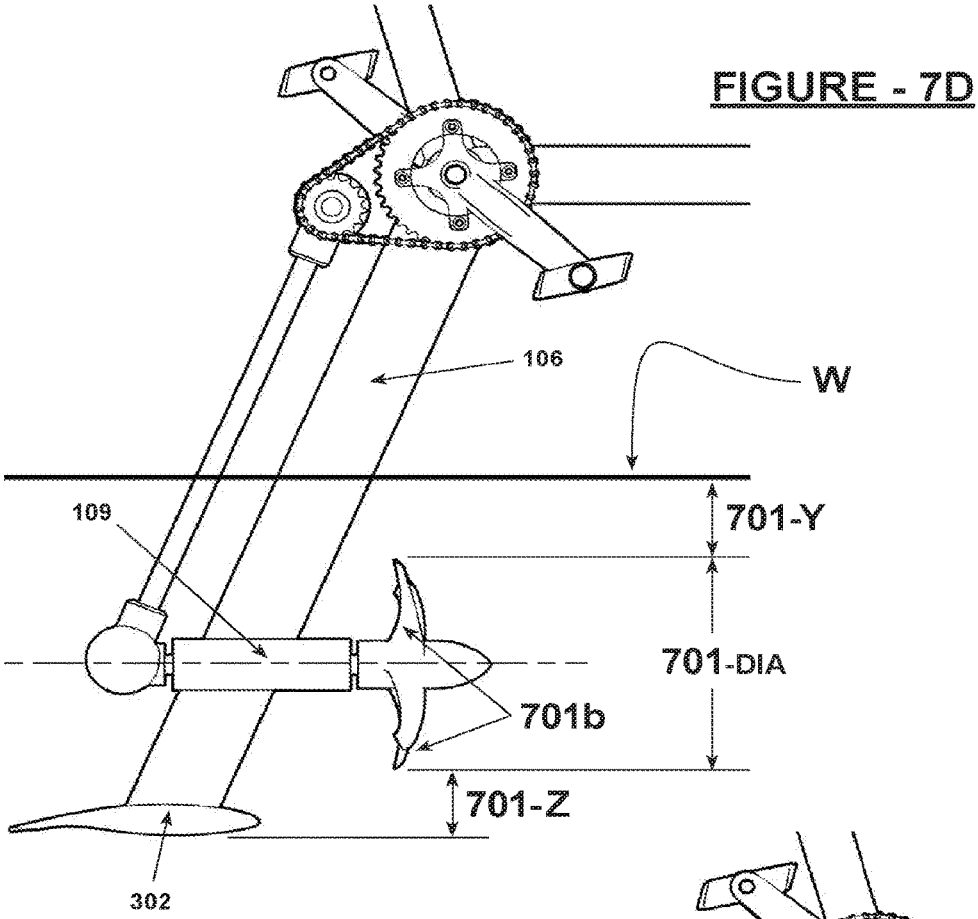
FIGS. 7D & 7E are diagrams of typical locations where the propeller can be positioned, relative to the water surface and the rear foil while the bike is in cruise mode.

FIG. 7D is a diagram where the trust tube (109) and therefore the rotational axis of the propeller (701) is positioned substantially higher than the chord of the rear foil (302) whereby the distance (701-Z) between the bottom of the rear foil (302) and the lower extremity of the circular travel path of the blade ends (701-X) ranges from 0 to 100 mm. It will be apparent to persons skilled in the art that the thrust tube (109) needs to be positioned at an appropriate elevation along the rear strut (106) in order to achieve these ideals.

Figure 7E:
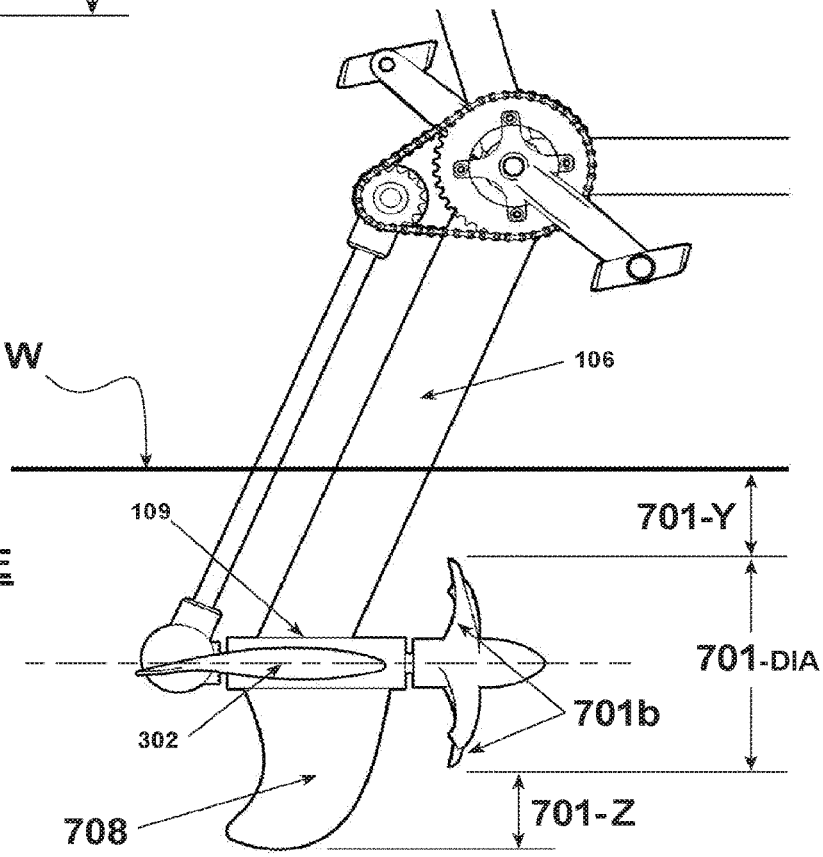

FIG. 7E is a diagram where the trust tube (109) and therefore the rotational axis of the propeller (701) is positioned at the same level of the rear foil (302). A strake or an arrangement of strakes (708) extending down from the bottom of the rear foil (302) can be utilised in order to protect the propeller blades (701*b*) from ground strikes, whereby the distance between the bottom end of the strake/s (708) and the lower extremity of the circular travel path of the blade ends (701-X) ranges from 0 to 100 mm.

The scope of the various locations for the propeller (701) can be anywhere in between the ideals specified in FIGS. 7D and 7E. While the rear foil (302) is lower than the front foil (301), an imaginary line between the bottom of these two foils (301, 302) is preferably sufficiently low that the propeller (701) is above this line and hence is elevated above a surface if both foils (301, 302) are resting upon such a surface.

Figure 8:
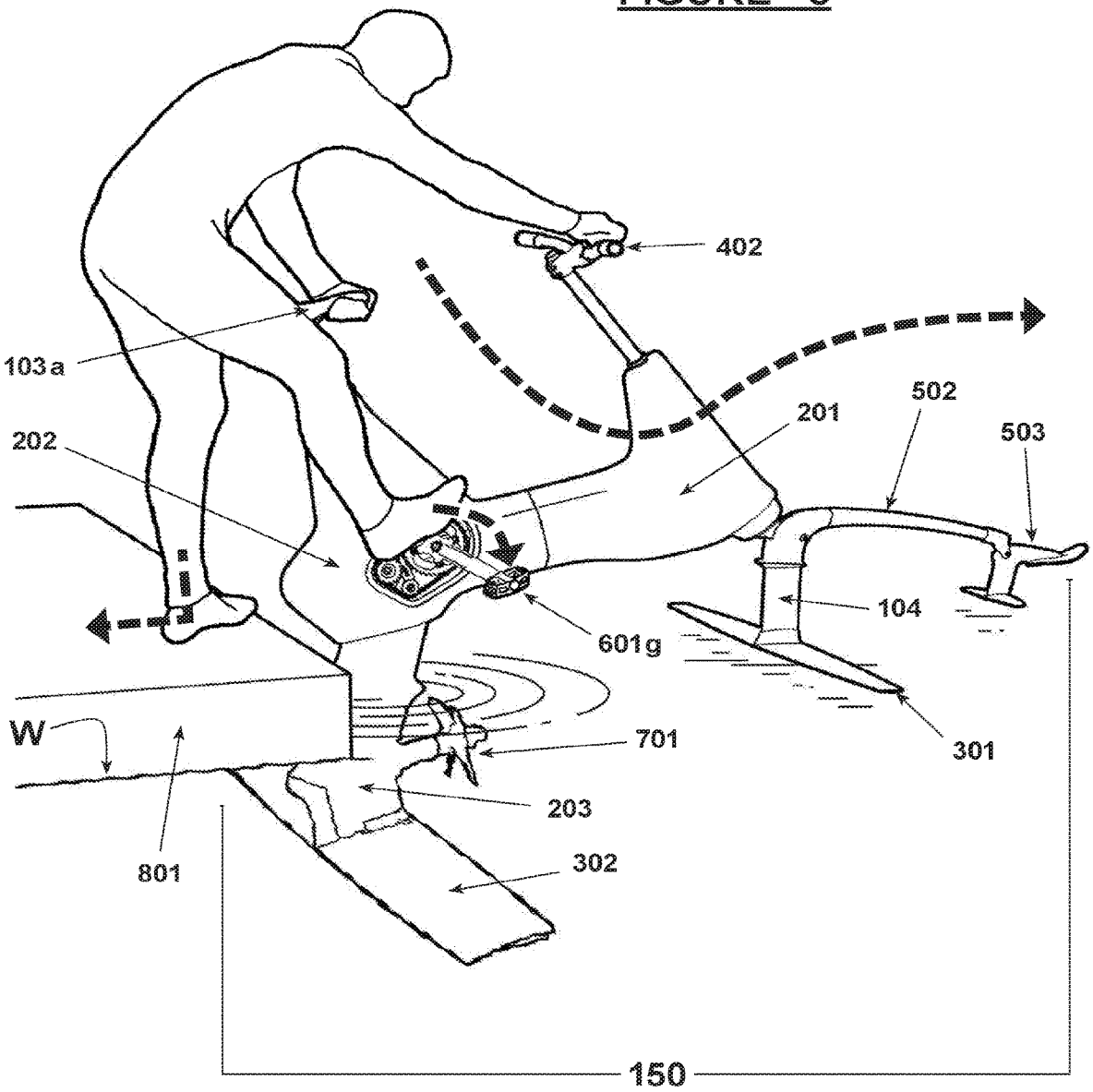
FIG. 8 is a perspective view depicting a favorable starting position for the hydrofoil bike with an 'above-water' jetty launch maneuver.

Launching the hydrofoil bike (150) from a structure above the water (W) is illustrated in FIG. 8. The user lowers the rear foil (302) and propeller (701) into the water (W), while standing on an appropriate platform (801). The orientation of the bike (150) is such that the tiller module (500) as well as the front foil (301) remains momentarily above the water (W). While initially holding the saddle (103*a*) with one hand, and holding the handlebar (402) with the other, the user lunges forward in one fluent motion, by pushing off with one foot while simultaneously placing the preferred foot onto the leading pedal (601*g*). The user then sits on the saddle (103*a*) and pedals immediately to generate propulsion and therefore lift.

Launching the hydrofoil bike (150) from a semi-submerged position in deep water (W) is illustrated in FIG. 9. The user swims to the hydrofoil bike (150) and re-orients it to an upright position. Learnt skill is required for the user to be able to mount the bike (150) (not seated but with feet planted on both pedals), while keeping the bike orientation substantially horizontal while stationary—as depicted in the illustration. As the user's weight is shifted above the vehicle, the inherently buoyant bike (150) will sink completely underwater—with the user ending up being chest deep in water when static and momentary equilibrium is achieved.

Until some forward movement is attained by pedaling, the user should refrain from placing too much weight onto the handlebars (402) otherwise static equilibrium is lost. This is because without forward movement, the front foil (301) is not producing any lift to support the weight of the user, should it bear down on the front section (100F) of the bike. As the bike gradually attains adequate speed to be able to produce sufficient lift to elevate the bike out of the water, the user is able to lean forward while pedaling hard off the saddle (standing) and continually adjusts his or her body weight (forward or aft) to achieve the ideal sub-launching pitch (or angle of attack) for the rear foil (302). This is a very satisfying intuitive skill that can only be mastered by practicing and repetition.

Figure 10:
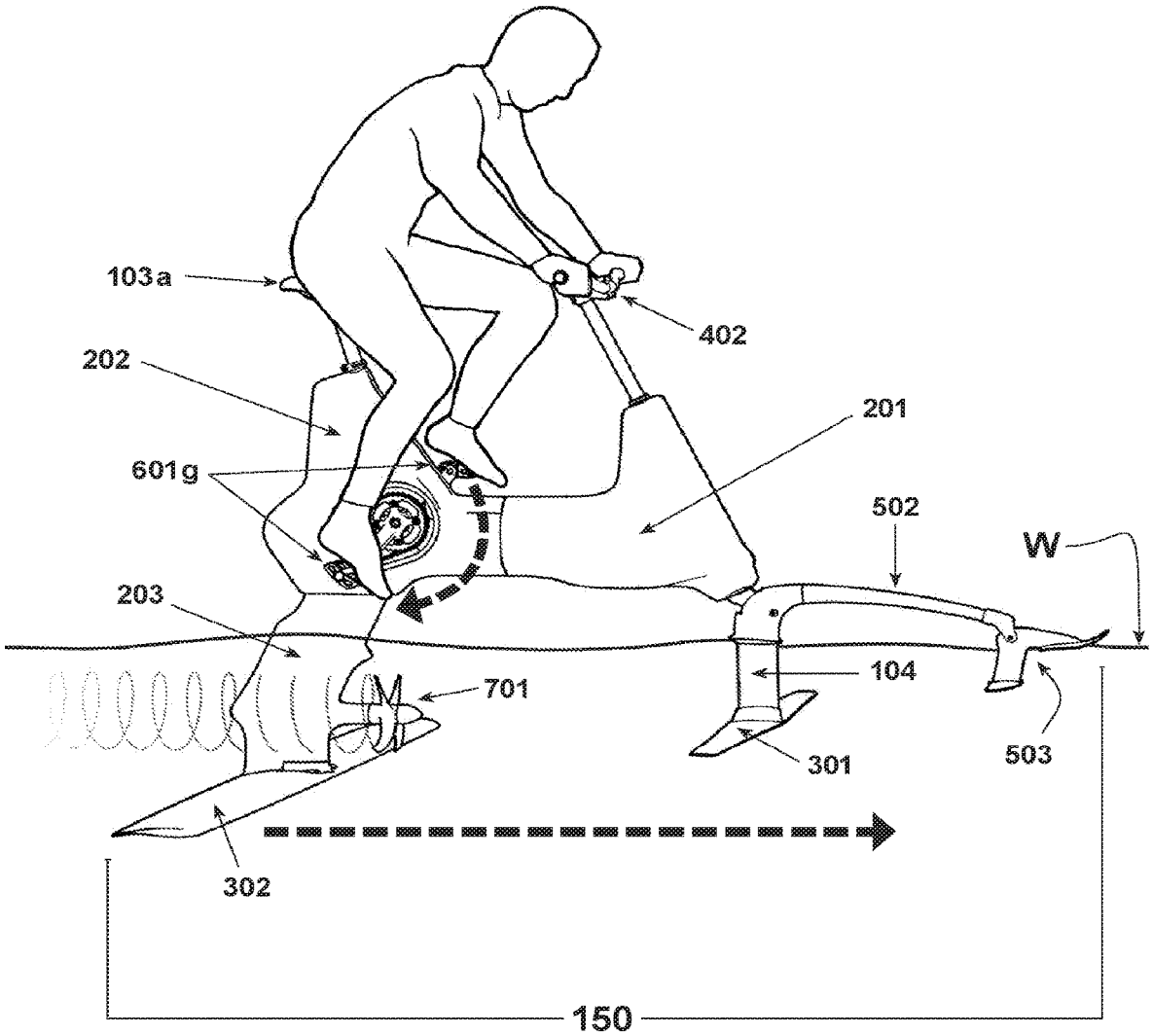
FIG. 10 is a perspective view depicting a favorable above-water surface cruising position.

Operating the hydrofoil bike (150) from above the water surface at cruising speed is illustrated in FIG. 10. Once the bike (150) has achieved sufficient speed commencing from a launch off a structure (801) substantially above the water (as depicted in FIG. 8), or commencing from a submerged launch (as depicted in FIG. 9)—the rear foil (302) will produce sufficient lift to elevate the rider and the upper portion of the bike (150) above the water (W) surface. The tiller head (503, in this instance a mini tiller) will be able to sustain its propensity to travel along the surface of the water (W). In so doing, the tiller arm (502) will be pivotally and dynamically actuated by the tiller head (503). Because the front strut (104) is unified with the tiller arm (502), the pivotal movements of these members are directly proportionate to each other.

As the front strut (104) swings in its predetermined forward/aft pendulum motion, the front foil (301) which is attached to the bottom end of the front strut (104) will undergo a change in angle of attack depending on the tiller arm (502) orientation. If the bike (150) is cruising too low, the tiller head (503) skimming on the water (W) surface will spontaneously actuate the tiller arm (502) to adopt an upward orientation which will produce a positive angle of attack for the front foil (301). Inversely, if the bike (150) is cruising too high, the tiller head (503) will spontaneously actuate the tiller arm (502) to adopt a downward orientation which will produce a negative angle of attack for the front foil (301). Therefore, the ideal cruising elevation of the bike (150) in relation to the water (W) surface is maintained during speed variations within an acceptable cruising speed range—because the front foil (301) acts as the elevator control in a canard configuration where the rear wing (302) is the main source of lift for the vehicle.

INDUSTRIAL APPLICABILITY

This invention exhibits industrial applicability in that it provides a pedal (or other human) powered water vehicle, using hydrofoil wings and a pedal (or other) driven prime mover, for transportation over a body of water.

Another object of the present invention is to provide a pedal powered hydrofoil water vehicle which can be started from a standstill substantially entirely submerged, and a rider can ride up out of the water until most of the vehicle other than the hydrofoils is above the water's surface.

Another object of the present invention is to provide a hydrofoil human powered vehicle for passing over bodies of water.

Another object of the present invention is to provide a water vehicle which is human powered and efficiently transports a rider over the body of water.

Another object of the present invention is to provide a human powered hydrofoil vehicle which can be fitted with various different hydrofoil wings which are interchangeable to vary performance characteristics of the vehicle.

Another object of the present invention is to provide a human powered vehicle for transportation over a body of water which includes limited buoyancy, such that the vehicle is close to neutrally buoyant and a single user can readily change the orientation of the vehicle in various different ways while in the water with the vehicle, to allow a rider to mount the vehicle before it is moving and to drive the vehicle from a submerged start into a planing orientation with most of the vehicle above a surface of the water, other than hydrofoils thereof.

Another object of the present invention is to provide a hydrofoil vehicle which can be effectively launched from a dock or other platform above a surface of the water while a rider is upon the vehicle.

Another object of the present invention is to provide a method for launching a human powered hydrofoil vehicle from a deep water start position.

Another object of the present invention is to provide a method for launching a human powered hydrofoil vehicle from a dock or other platform elevated above a surface of the water.

Another object of the present invention is to provide a human powered hydrofoil vehicle which can be conveniently disassembled into subparts sufficiently small to allow easy shipping and transportation thereof, such as in a car, for transport to a body of water for use.

Other further objects of this invention which demonstrate its industrial applicability, will become apparent from a careful reading of the included detailed description, from a review of the enclosed drawings and from review of the claims included herein.

What is claimed is:

1. A hydrofoil vehicle, comprising in combination:

a substantially rigid frame having a front section and a rear section, the front section being forward of the rear section in a longitudinal direction;

a front foil connected beneath said front section of said substantially rigid frame;

a rear foil connected beneath said rear section of said substantially rigid frame;

said front foil and said rear foil each having an elongate form extending laterally relative to the longitudinal direction, and with a foil shape and orientation which causes lift when moving forward through water;

a propeller located beneath and supported by said substantially rigid frame, said propeller powered by a power source carried by said substantially rigid frame;

said power source includes pedal cranks rotatably coupled to said propeller to power said propeller as said pedal cranks rotate, said pedal cranks adapted to be rotated by a human rider carried upon said substantially rigid frame, said propeller coupled to said power source through a drive train therebetween, characterised by said propeller extending forward from portions of said drive train adjacent to said propeller.

2. The hydrofoil vehicle of claim 1, wherein said propeller is located according to one or more of the following:

(a) entirely above said lowermost one of said front foil and said rear foil;

(b) forward of said rear foil and rearward of said front foil;

(c) wherein said rear foil is lower than said front foil, said propeller is located above said rear foil and supported by said rear section of said substantially rigid frame; or (d) above a plane extending between said rear foil and said front foil.

3. The hydrofoil vehicle of claim 1, wherein said power source includes a motor installed within a drive path of the drive train and configured to provide drive power to the propeller.

4. The hydrofoil vehicle of claim 3, wherein said motor is coupled to a battery unit configured to provide power to the motor.

5. The hydrofoil vehicle of claim 1, wherein the motor is positioned on the drive train and transmits power to the propeller to enable a pedal-assist and/or a fully motor driven mode.

6. The hydrofoil vehicle of claim 1, wherein said propeller is coupled to a driveshaft which causes said propeller to rotate, said driveshaft coupled to said propeller through a free wheel linkage which causes said propeller to rotate when said driveshaft rotates in a first direction, and which does not cause said propeller to rotate when said driveshaft rotates in a second direction opposite said first direction.

7. The hydrofoil vehicle of claim 1, wherein at least one of said front foil and said rear foil are removably connected beneath said frame, through a joint which facilitates rapid removal and secure re-attachment to said frame.

8. The hydrofoil vehicle of claim 7, wherein said rear foil is removably connected beneath said substantially rigid frame through a bayonet interface joint comprising male and female counterparts and with one of said male counterpart or female counterpart affixed to a central portion of said rear foil and with the other of said male counterpart or female counterpart affixed to a lower portion of said rear section of said substantially rigid frame.

9. The hydrofoil vehicle of claim 1, wherein said frame rear section includes a rear strut and a tube located at or near a bottom end of said rear strut, said propeller being coupled on a front side of said tube, and wherein a driveshaft is coupled to said propeller and causes said propeller to rotate, wherein said driveshaft is located within or adjacent to a part of said rear strut.

10. The hydrofoil vehicle of claim 1, wherein as least a portion of said substantially rigid frame is formed as a monocoque shell structure, the monocoque shell structure including buoyancy material located within internal compartments of the substantially rigid frame, the buoyancy material configured to provide sufficient buoyancy to the hydrofoil vehicle to cause it to have positive buoyancy.

11. The hydrofoil vehicle of claim 1, further comprising a steering assembly coupled to the front section of the substantially rigid frame, the steering assembly including a steering fork comprising a steerer tube with a forward-facing elongated horn formed at the base, the forward-facing elongated horn being coupled to the front foil, and the upper end of the steerer tube is configured to receive a handlebar to allow a user to actuate the steerer tube to rotate about a central axis, such that the fork horn will move in synchrony with the movement of the handlebars.

12. The hydrofoil vehicle of claim 11, wherein the steering assembly further comprises a pivotably mounted tiller module extending forward of the front section of the substantially rigid frame and coupled to the forward-facing elongated horn, the tiller module comprising a forward-extending tiller arm and a pivotably mounted tiller head at the leading end of the tiller arm.

13. The hydrofoil vehicle of claim 12, wherein the tiller arm is arched or bowed downward towards the front end, and the rear end of the tiller arm is coupled to the front foil through a pivot junction to facilitate unified movement of the tiller arm and front foil.

14. The hydrofoil vehicle of claim 12, wherein the tiller head is configured as a skid plate, a streamlined bulb or nose cone with a suitable shape to glide below and/or along the surface of the water.

15. The hydrofoil vehicle of claim 13, wherein the steering assembly further comprises a user activated actuator to enable the user to adjust an angle of attack of the front foil and tiller arm.

16. The hydrofoil vehicle of claim 1, wherein the propeller includes a plurality of rotatable blades that extend from a central boss, the plurality of rotatable blades being surrounded by a protective shroud.

17. The hydrofoil vehicle of claim 1, wherein the substantially rigid frame includes a substantially horizontal body portion connected at a front end to an elongated front strut and connected at a rear end to an elongated rear strut, the elongated front strut and elongated rear strut arranged to extend below the horizontal body portion, the lower end of the elongated front strut being coupled to the front foil and the lower end of the elongated rear strut being coupled to the rear foil.

18. The hydrofoil vehicle of claim 17, wherein at least one of the front strut and the rear strut are removably attachable to the horizontal body portion.

19. The hydrofoil vehicle of claim 17, wherein the propeller is coupled to the elongated rear strut and arranged to extend forward of the rear strut and forward of the leading edge of the rear foil.

20. The hydrofoil vehicle of claim 17, wherein the elongated front strut and elongated rear strut are angled downwards in a substantially forward and substantially rearward direction respectively.

* * * * *